US005750299A

United States Patent [19]

Ohshima et al.

[11] Patent Number: 5,750,299

[45] Date of Patent: May 12, 1998

[54] METHOD OF FORMING COLORED IMAGE BY USE OF INORGANIC TONER, INORGANIC TONER FOR DEVELOPING LATENT ELECTROSTATIC IMAGE, AND COLORED TONER IMAGE BEARING IMAGE TRANSFER MEDIUM

[75] Inventors: Kouchi Ohshima, Mishima; Shinichi Kuramoto, Numazu; Hiromitsu Kawase, Mishima; Yoichiro Watanabe, Fuji; Takamichi Enomoto, Numazu; Masanaga Imamura, Fujinomiya; Katsumi Kuboshima; Junji Toda, both of Shizuoka, all of Japan

[73] Assignee: Ricoh Company, Ltd., Tokyo, Japan

[21] Appl. No.: 672,481

[22] Filed: Jun. 26, 1996

[30] Foreign Application Priority Data

Jun. 26, 1995 [JP] Japan ..... 7-182118
Apr. 30, 1996 [JP] Japan ..... 8-132734

[51] Int. Cl.[6] ..... G03G 13/16

[52] U.S. Cl. ..... 430/47; 430/99; 430/126

[58] Field of Search ..... 430/47, 45, 106, 430/126, 99

[56] References Cited

U.S. PATENT DOCUMENTS 4,795,689 1/1989 Matsubara et al. ..... 430/99
4,990,427 2/1991 Kohri et al. ..... 430/110
5,300,383 4/1994 Tsubota et al. ..... 430/45
5,427,894 6/1995 Metzger ..... 430/291

FOREIGN PATENT DOCUMENTS 0 280 378 8/1988 European Pat. Off. .
40 41 358 7/1992 Germany .

OTHER PUBLICATIONS

Patent Abstracts of Japan, vol. 11, No. 170, (P–581), JP 62 002272, Jan. 8, 1987.

Derwent Abstracts, AN 87–174027, and Patent Abstracts of Japan , vol.11, No. 313, (P–626), JP 62 105 158, May 15, 1987.

*Primary Examiner*—John Goodrow
*Attorney, Agent, or Firm*—Oblon, Spivak, McClelland, Maier & Neustadt, P.C.

[57] ABSTRACT

A method of forming a colored image on a heat resistant solid surface by use of a toner-image-layer-bearing image formation medium; a method of forming the toner-image-layer bearing image formation medium; inorganic toners for the formation of inorganic toner image for proposed.

53 Claims, 2 Drawing Sheets

METHOD OF FORMING COLORED IMAGE BY USE OF INORGANIC TONER, INORGANIC TONER FOR DEVELOPING LATENT ELECTROSTATIC IMAGE, AND COLORED TONER IMAGE BEARING IMAGE TRANSFER MEDIUM

BACKGROUND OF THE INVENTION

1. Field of the Invention

The present invention relates to a method of forming a toner image layer on an image formation film, a method of forming a colored image on a heat resistant solid surface by use of the above prepared toner image layer bearing image formation film, and an inorganic toner and an image transfer medium which bears a toner image thereon for use in the above methods.

2. Discussion of Background

A screen printing method is known as a method of forming a colored image on a heat resistant solid surface, as disclosed in Japanese Laid-Open Patent Application 49-35407.

In this screen printing method, a colored image is formed on a ceramic product in accordance with the following procedure:

A water-soluble paste layer is formed on a base paper. On the water-soluble paste layer, a transfer medium, when necessary, provided with a vinyl or cellulose-based resin layer thereon, is placed. On this transfer medium, an image is printed with an ink comprising an inorganic coloring material by the screen printing method.

A protective resin layer is provided on the printed image, whereby an image transfer paper is fabricated.

The thus fabricated image transfer paper is immersed into water. The paste layer is dissolved in water, so that the base paper peels off, whereby there can be obtained a resin film which bears thereon an image composed of an inorganic coloring material.

The thus obtained resin film is applied to the body of a ceramic product and burned, whereby an image bearing ceramic product can be obtained.

According to this method, a printing plate for the screen printing is required to be made. Since a basic printing mode of the screen printing is multi-color printing, 10 or more kinds of printing plates are usually required to obtain colorful images. Therefore the cost for making such printing plates is high and the screen printing method is apt to make worse the working conditions due to an air pollution problem caused by the evaporation of organic solvents from the ink employed in the screen printing.

Japanese Laid-Open Application 4-135798 proposes a method of solving the above-mentioned problems in the screen printing method.

According to the proposed method, an image transfer paper coated with a glaze for ceramic colors is employed.

A toner image is then formed on the image transfer paper by a dry type copying machine, whereby a toner image bearing image transfer paper is prepared. The thus prepared toner image bearing image transfer paper is then applied to the body of a ceramic product and burned, whereby there can be obtained a ceramic product to which the toner image is fixed.

According to this method, however, since an inorganic-powder-containing toner is employed, the iron powder is decolorized at the time of burning, so that a ceramic product with an image having a desired color tone cannot always be obtained. Furthermore, images obtained by this method are monochrome and no full-color images cannot be obtained.

Furthermore, Japanese Laid-Open Patent Application 62-22308 discloses a method of forming images on a ceramic product by the steps of preparing a clay bearing sheet composed of a combustible base sheet and clay which is daubed on the surface of the base sheet; forming a toner image on the surface of the clay bearing sheet, thereby preparing a toner-image-bearing sheet; and burning the toner-image-bearing transfer sheet.

According to this method, however, images obtained are monochrome, specifically, brown images composed of burned inorganic magnetic materials, and no full-color images cannot be obtained.

SUMMARY OF THE INVENTION

Therefore it is a first object of the present invention is to provide an industrially usable method of forming a toner image layer bearing image formation film for use in an image formation method of forming any colored image, which may be a full-color image, on a heat resistant solid surface by electrophotography.

A second object of the present invention is to provide an industrially usable image formation method of forming any colored image, which may be a full-color image, on a heat resistant solid surface by use of the toner image layer bearing image formation film obtained in the first object of the present invention.

A third object of the present invention is to provide an inorganic toner for use in the above-mentioned respective methods.

A fourth object of the present invention is to provide an image transfer medium which bears thereon a colored image layer for use in the respective methods of the first and second object of the present invention.

The first object of the present invention can be achieved by a first method of forming a toner image layer comprising at least one colored toner image layer on an image formation film, comprising the steps of:

developing a latent electrostatic image with at least one color toner which comprises an inorganic coloring material and a binder resin to a colored toner image;

transferring the colored toner image to a surface of an image formation film of an image transfer medium which comprises an image formation film comprising a heat-vanishing material and/or a thermofusible inorganic material at least one time or a plurality of times; and fixing the colored toner image to the image formation film at least one time to form a colored toner image layer thereon.

In the present invention, a toner image layer comprising a plurality of colored toner image layers can be formed on an image formation film, for example, by any of the following methods:

(1) A method of successively forming a plurality of colored toner image layers on an intermediate image transfer medium, and transferring the plurality of colored toner image layers to an image formation film and fixing the colored toner image layers thereto.

(2) A method of successively transferring a plurality of colored toner image layers to an image formation film and then fixing the colored toner image layers thereto.

(3) A method of transferring a colored toner image layer to an image formation film and fixing the colored toner image layer thereto; and repeating this transfer and fixing steps.

If multiple colored toner image layers can be formed on an image transfer film, such an image transfer film can also be employed instead of the above-mentioned methods.

The first object of the present invention can also be achieved by a second method of forming a toner image layer comprising at least one colored toner image layer and at least one thermofusible toner image layer on an identical image formation film, by use of process A and process B in combination, the process A comprising the steps of:

developing a latent electrostatic image with at least one color toner which comprises an inorganic coloring material and a binder resin to a colored toner image;

transferring the colored toner image to a surface of an image formation film of an image transfer medium which comprises an image formation film comprising a heat-vanishing material and/or a thermofusible inorganic material; and fixing the colored toner image to the surface of the image formation film to form a colored toner image layer thereon; and the process B comprising the steps of:

developing a latent electrostatic image with at least one thermofusible toner which comprises a thermofusible inorganic material which is capable of forming a transparent vitreous solid when cooled after fused, and a binder resin to a thermofusible toner image;

transferring the thermofusible toner image to the surface of the image formation film of the image transfer medium; and fixing the thermofusible toner image to the surface of the image formation film to form a thermofusible toner image layer thereon.

The first object of the present invention can also be achieved by a third method of forming a toner image layer comprising at least one colored toner image layer on an image formation film, with a thermofusible inorganic material layer or a thermofusible toner layer being provided on the color toner image layer, comprising the steps of:

developing a latent electrostatic image with at least one color toner which comprises an inorganic coloring material and a binder resin to a colored tower image;

transferring the colored toner image to a surface of an image formation from of an image transfer medium which comprises an image formation film comprising a heat-vanishing material and/or a the fusible inorganic material one time or a plurality of times;

fixing the colored toner image to the image formation film at least one time to form a colored toner image layer on the image formation film; and forming a thermofusible inorganic material layer comprising a thermofusible inorganic material capable of forming a transparent vitreous solid when cooled after fused, or a thermofusible toner layer comprising the thermofusible inorganic material and a binder resin, on the color toner image layer.

The second object of the present invention can be achieved by a first method of forming a colored image on a heat resistant solid surface comprising the steps of:

developing a latent electrostatic image with at least one color toner which comprises an inorganic coloring material and a binder resin to a colored toner image;

transferring the colored toner image to a surface of an image formation film of an image transfer medium which comprises an image formation film comprising a heat-vanishing material and/or a thermofusible inorganic material one time or a plurality of times;

fixing the colored toner image to the surface of the image formation film at least one time, thereby forming a toner-image-layer-bearing image formation film, with the toner image layer comprising at least one colored toner image layer; and overlaying the toner-image-layer-bearing image formation film on the heat resistant solid surface; and burning the toner-image-layer bearing image formation film in a temperature range in which the thermofusible inorganic material is melted.

The second object of the present invention can also be achieved by a second method of forming a colored image on a heat resistant solid surface comprising the steps of:

(I) preparing a toner-image-layer bearing image formation film by forming a toner image layer comprising at least one colored toner image layer and at least one thermofusible toner image layer on an identical image formation film, by use of process A and process B in combination, the process A comprising the steps of:

developing a latent electrostatic image with at least one color toner which comprises an inorganic coloring material and a binder resin to a colored toner image;

transferring the colored toner image to a surface of an image formation film of an image transfer medium which comprises an image formation film comprising a heat-vanishing material and/or a thermofusible inorganic material; and fixing the colored toner image to the surface of the image formation film to form a colored toner image layer thereon; and the process B comprising the steps of:

developing a latent electrostatic image with at least one thermofusible toner which comprises a thermofusible inorganic material which is capable of forming a transparent vitreous solid when cooled after fused, and a binder resin to a thermofusible toner image;

transferring the thermofusible toner image to the surface of the image formation film of the image transfer medium; and fixing the thermofusible toner image to the surface of the image formation film to form a thermofusible toner image layer thereon, thereby preparing a toner-image-layer bearing image formation film; and (II) overlaying the toner-image-layer-bearing image formation film on the heat resistant solid surface; and burning the toner-image-layer bearing image formation film in a temperature range in which the thermofusible inorganic material is melted.

The second object of the present invention can be achieved by a third method of forming a colored image on a heat resistant solid surface comprising the steps of:

(I) preparing a toner-image-bearing image formation film by forming a toner image layer comprising at least one colored toner image layer on an image formation film, with a thermofusible inorganic material layer or a thermofusible toner layer being provided on the color toner image layer, comprising the steps of:

developing a latent electrostatic image with at least one color toner which comprises an inorganic coloring material and a binder resin to a colored toner image;

transferring the colored toner image to a surface of an image formation film of an image transfer medium which comprises an image formation film comprising a heat-vanishing material and/or a thermofusible inorganic material;

fixing the colored toner image to the image formation film at least one time to form a colored toner image layer on the image formation film; and forming a thermofusible inorganic material layer comprising a thermofusible inorganic material capable of forming a transparent vitreous solid when cooled after fused, or a thermofusible toner layer comprising the thermofusible inorganic material and a binder resin, on the color toner image layer, thereby preparing a toner-image-bearing image formation film; and (II) overlaying the toner-image-layer-bearing image formation film on the heat resistant solid surface; and burning the toner-image-layer bearing image formation film in a temperature range in which the thermofusible inorganic material is melted.

The third object of the present invention can be achieved by an inorganic toner for developing latent electrostatic image comprising an inorganic coloring material and a binder resin.

The third object of the present invention can also be achieved by an inorganic toner for developing latent electrostatic image comprising an inorganic coloring material, a thermofusible inorganic material which is capable of forming a transparent vitreous solid when cooled after fused, and a binder resin.

The third object of the present invention can also be achieved by a thermofusible toner for developing latent electrostatic image comprising a thermofusible inorganic material which is capable of forming a transparent vitreous solid when cooled after fused, and a binder resin.

The third object of the present invention can also be achieved by an inorganic toner for developing latent electrostatic image comprising:

(a) a color toner comprising an inorganic coloring material and a binder resin; and (b) a thermofusible toner comprising a thermofusible inorganic material which is capable of forming a transparent vitreous solid when cooled after fused, and a binder resin.

The fourth object of the present invention can be achieved by an image transfer medium comprising an image formation film which comprises a heat-vanishing material and/or a thermofusible inorganic material, constituting an image formation surface, with a toner image layer comprising at least one colored toner image and at least one thermofusible toner layer being formed on the image formation film.

The fourth object of the present invention can also be achieved by an image transfer medium comprising an image formation film which comprises a heat-vanishing material and/or a thermofusible inorganic material, constituting an image formation surface, with a toner image layer comprising at least one colored toner image being formed on the image formation film, and with a thermofusible inorganic material layer comprising a thermofusible inorganic material capable of forming a transparent vitreous solid when cooled after fused, or a thermofusible toner layer comprising the thermofusible inorganic material and a binder resin, being overlaid on the color toner image layer.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1(*b*) is a schematic cross-sectional view of an example of an image transfer medium which bears toner images thereon of the present invention, FIG. 2(*a*) is a schematic cross-sectional view of another example of an image transfer medium which bears no toner images thereon of the present invention.

FIG. 3(*b*) is a schematic cross-sectional view of a further example of an image transfer medium which bears toner images thereon of the present invention.

FIG. 3(*a*) is a schematic cross-sectional view of still another example of an image transfer medium which bears toner images thereon of the present invention.

DESCRIPTION OF THE PREFERRED EMBODIMENTS

Figure 1A:
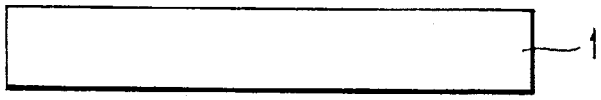
FIG. 1(*a*) is a schematic cross-sectional view of an example of an image transfer medium which bears no toner images thereon of the present invention.

The first object of the present invention can be achieved by a first method of forming a toner image layer comprising at least one colored toner image layer on an image formation film, comprising the steps of;

developing a latent electrostatic image with at least one color toner which comprises an inorganic coloring material and a binder resin to a colored toner image;

transferring the colored toner image to a surface of an image formation film of an image transfer medium which comprises an image formation film comprising a heat-vanishing material and/or a thermofusible inorganic material one time or a plurality of times; and fixing the colored toner image to the image formation film at least one time to form a colored toner image layer thereon.

As the inorganic coloring material for the color toner for use in the present invention, a variety of coloring materials used in ceramics can be employed.

Examples of such an inorganic coloring material for use in the present invention include colored heat resistant particles, such as particles of metallic oxide, metallic oxide solid solution, composite metal oxide, composite metal oxide solid solution, silicate, silicate solid solution, metallic sulfide, selenium compound or selenium sulfide compound, metal powder, and metallic colloid.

Specific examples of metal oxide include red oxide and chrome green.

Specific examples of metallic oxide solid solution include manganese pink, chrome alumina green, chrome titanium yellow, vanadium tin yellow, Sb-containing tin oxide, and vanadium zirconium yellow.

Specific examples of composite metallic oxide include $(Zn, Co)O.Al_2O_3$, $ZnO.(Al, Cr)_2O_3$, $(Zn, Co)O.(Al, Cr)_2O_3$, $ZnO.(Al, Cr, Fe)_2O_3$, $MnO.Cr_2O_3$, $(Mn, Co)O.(Cr, Fe)_2O_3$, and $CuO.Cr_2O_3$.

Specific examples of composite metallic oxide solid solution include antimony yellow.

Specific examples of silicate are cobalt silicate [composition; cobalt olivine $2Co.SiO_2$], Nickel Green [composition: nickel olivine $2(Ni, Zn).SiO_2$] and uvarovite.

Specific examples of silicate solid solution are chrome tin pink, vanadium blue, Turkish Blue, praseodymium yellow, and Coral Red.

Specific examples of metallic sulfide include cadmium orange.

Specific examples of selenium sulfide compound include cadmium red, and selenium red.

Specific examples of metal powder include powders of gold, silver, copper, platinum, and rhodium.

Specific examples of metal colloid include colloids of gold, silver, copper, platinum, and rhodium.

The colored toner image layer in the above-mentioned method may comprise at least two colored layers selected from the group consisting of a yellow toner image layer, a magenta toner image layer, a cyan toner image layer and a black toner image layer, so that when a full color image is formed, a yellow color toner, a magenta color toner, a cyan color toner and a black color toner are employed.

In the present invention, since the toner image layer formed on an image formation film is overlaid on a heat resistant solid surface and then burned, it is most desirable that the color tone of the employed toner be maintained even on the burned color image formed on the heat resistant solid surface. Therefore, it is desired that the changes in the color tone of the inorganic coloring material employed in the color toner be minimal at the burning temperature, in particular when a multi-color or full color image is formed on the heat resistant solid surface.

The color toner for use in the present invention may further comprise color a thermofusible inorganic material which can be melted when heated or can be fused and is capable of forming a transparent vitreous solid when cooled after fused. The vitreous solid may be colored as long as it is transparent.

Examples of such a thermofusible inorganic material for use in the color toner include a single inorganic compound, a mixture of a plurality of inorganic compounds, glass powder, a natural mineral, and clay.

A preferable thermofusible inorganic material for use in the color toner is such a thermofusible inorganic material that forms a transparent vitreous solid which is composed of a basic oxide, a neutral oxide, and an acidic oxide.

Specific examples of the basic oxide include $Na_2O$, $K_2O$, CaO, MgO, BaO, ZnO, FeO, MnO, PbO and CdO.

Specific examples of the neutral oxide include $Al_2O_3$, $B_2O_3$, $Fe_2O_3$, $Sb_2O_3$ and $Cr_2O_3$.

Specific examples of the acidic oxide include $SiO_2$, $TiO_2$ and $ZrO_2$.

The thermofusible inorganic material for use in the present invention can be obtained by mixing a basic oxide source material, a neutral oxide source material and an acidic oxide source material in such a manner that the above-mentioned vitreous solid can be obtained when cooled after fused.

Examples of the basic oxide source material include alkali metal compound, alkaline earth metal compound, and natural materials containing any of the above-mentioned compounds.

Examples of the neutral oxide source material include aluminum compound, boron compound, and natural materials containing any of the above-mentioned compounds.

Examples of the acid oxide source material include silicon compound, titanium compound, zirconium compound, and natural materials containing any of the above-mentioned compounds.

Specific examples of the thermofusible inorganic material are alumina ($Al_2O_3$), barium carbonate ($BaCO_3$), borax ($Na_2O.2B_2O_3.10H_2O$), cadmium sulfide (CDs), calcium carbonate ($CaCO_3$), fluorite ($CaF_2$), cobalt nitrate ($Co(NO_3)_2.6H_2O$), cobalt oxide ($Co_2O_4$), cupric oxide (CuO), copper oxide ($Cu_2O$), potash feldspar ($K_2O.Al_2O_3.6SiO_2$), soda feldspar ($Na_2O.Al_2O_3.6SiO_2$), lime feldspar ($CaO.Al_2O_3.6SiO_2$), iron hydroxide ($Fe(OH)_3$), chromium oxide ($Cr_2O_3$), manganese oxide (mno), manganese oxide (red) ($Mn_3O_4$), lead sulfide (PbS), nickel oxide (NiO), silica ($SiO_2$), quartz ($SiO_2$), sodium carbonate ($Na_2CO_3$), sodium silicate ($NaSiO_3$), stannic oxide ($SnO_2$), titanium oxide ($TiO_2$), zinc oxide (ZnO), and kaolin ($Al_2O_3.2SiO_2.2H_2O$).

These thermofusible inorganic materials can be used alone or in the form of a mixture, or in the form of a frit which is formed by fusing a mixture thereof and pulverizing the mixture. Furthermore, such a frit can be used in combination with an unfused one or more thermofusible inorganic materials.

In the present invention, it is preferable to use the thermofusible inorganic material which comprises glass powder or which is in the form of a frit, which can be formed by pulverizing a vitreous solid which is obtained by fusing the thermofusible inorganic material and cooling the fused thermofusible inorganic material.

Alternatively, the thermofusible inorganic material for use in the present invention may comprise such glass powder.

Specific examples of such a frit include a lead-containing frit composed of $Na_2O$, $k_2O$, CaO, Pbo, $B_2O_3$, $Al_2O_3$ and $SiO_2$; and a lead-free frit composed of $Na_2O$, $k_2O$, CaO, $B_2O_3$, $Al_2O_3$, $SiO_2$; and a lead-free frit composed of $Na_2O$, $k_2O$, CaO, MgO, $B_2O_3$, $Al_2O_3$ and $SiO_2$.

It is preferable that the thermofusible inorganic material for use in the present invention has a fusing initiation temperature in the range of 400° to 1200° C., more preferably in the range of 500° to 1000° C. At the fusing initiation temperature, at least part of the thermofusible inorganic material exhibits a liquid phase.

In the present invention, the thermofusible inorganic material is used in the form of finely-divided particles not only in the color toner, but also in an image transfer medium for use in the present invention. It is preferable that the average particle size of the primary particles thereof be in the range of 0.01 to 50 μm, more preferably in the range of 0.01 to 10 μm, further more preferably in the range of 0.5 to 1 μm. When the thermofusible inorganic material is contained in the toner, it is preferable that the average particle size of the primary particles thereof be 2 μm or less, more preferably in the range of 0.1 to 1 μm.

Specific examples of a binder resin for use in the color toner include styrene and substituted styrene polymers, such as polystyrene, poly p-chlorostyrene, polyvinyl toluene; styrene copolymers such as styrene—p-chlorostyrene copolymer, styrene—propylene copolymer, styrene—vinyltoluene copolymer, styrene—vinylnaphthalene copolymer, styrene—methyl acrylate copolymer, styrene—ethyl acrylate copolymer, styrenebutyl acrylate copolymer, styrene—octyl acrylate copolymer, styrene—methyl methacrylate copolymer, styrene—ethyl methacrylate copolymer, styrene—butyl methacrylate copolymer, styrene—methyl α-chloromethacrylate copolymer, styrene—acrylonitrile copolymer, styrene-vinyl methyl ketone copolymer, styrene—butadiene copolymer, styrene—isoprene copolymer, styrene—acrylonitrile—indene copolymer, styrene—maleic acid copolymer, and styrene—maleic acid ester copolymer; polymethyl methacrylate; polybutyl methacrylate; polyvinyl chloride; polyvinyl acetate; polyethylene; polypropylene; polyester; epoxy resin; epoxy polyol resin; polyurethane; polyamide; polyvinyl butyral; polyacrylic resin; rosin; modified rosin; terpene resin; aliphatic or aromatic petroleum resin; chlorinated paraffin; and paraffin wax.

These binder resins can be used alone or in combination.

It is preferable that the color toner for use in the present invention have substantially the same average particle size as that of conventionally employed toner for electrophotography, namely a volume average particle size of about 4.0 to 12.0 μm, more preferably a volume average particle size of about 5.0 to 9.0 μm.

When the color toner comprises the previously mentioned inorganic coloring material, binder resin and thermofusible inorganic material, it is preferable that the amount ratio by weight of the inorganic coloring material to the thermofusible inorganic material be in the range of 95:5 to 5:95, more preferably in the range of 80:20 to 60:40.

It is preferable that the amount ratio of the binder resin be 40 vol. % or more, more preferably 50 vol. % or more, of the entire weight of the color toner. When the amount ratio of the binder resin be 60 vol. % or more of the entire weight of the color toner, the necessary characteristics for toner for electrophotography, such as stable charging characteristics and fixing characteristics, can be obtained.

The inorganic coloring material has a much smaller absorbance than that of an organic coloring material, so that as the relative amount of the inorganic coloring material in the color toner is increased, the color tone finally obtained by the color toner can be made darker.

Furthermore, as the relative amount of the binder resin in the color toner is decreased, the shape retention of each color toner particle becomes difficult.

Therefore, in the case of a color toner which consists of the inorganic coloring material, the thermofusible inorganic material, and the binder resin, there is a limitation to the total amount of the inorganic coloring material that can be employed, so that there may be the case where images with satisfactory dark color tone cannot be obtained.

Such a problem can be solved by a second method and a third method by which the first object of the present invention can also be achieved.

The second method is for forming a toner image layer comprising at least-one colored toner image layer and at least one thermofusible toner image layer on an identical image formation film, by use of process A and process B in combination, the process A comprising the steps of:

developing a latent electrostatic image with at least one color toner which comprises an inorganic coloring material and a binder resin to a colored toner image;

transferring the colored toner image to a surface of an image formation film of an image transfer medium which comprises an image formation film comprising a heat-vanishing material and/or a thermofusible inorganic material; and fixing the colored toner image to the surface of the image formation film to form a colored toner image, layer thereon; and the process B comprising the steps of:

developing a latent electrostatic image with at least one thermofusible toner which comprises a thermofusible inorganic material which is capable of forming a transparent vitreous solid when cooled after fused, and a binder resin to a thermofusible toner image;

transferring the thermofusible toner image to the surface of the image formation film of the image transfer medium; and fixing the thermofusible toner image to the surface of the image formation film to form a thermofusible toner image layer thereon.

The third method is for forming a toner image layer comprising at least one colored toner image layer on an image formation film, with a thermofusible inorganic material layer or a thermofusible toner layer being provided on the color toner image layer, comprising the steps of:

developing a latent electrostatic image with at least one color toner which comprises an inorganic coloring material and a binder resin to a colored toner image;

transferring the colored toner image to a surface of an image formation film of an image transfer medium which comprises an image formation film comprising a heat-vanishing material and/or a thermofusible inorganic material;

fixing the colored toner image to the image formation film at least one time to form a colored toner image layer on the image formation film; and forming a thermofusible inorganic material layer comprising a thermofusible inorganic material capable of forming a transparent vitreous solid when cooled after fused, or a thermofusible toner layer comprising the thermofusible inorganic material and a binder resin, on the color toner image layer, by use of a thermofusible toner which comprises a thermofusible inorganic material and a binder resin, each of which may be respectively the same as mentioned previously.

Thus, the thermofusible toner for use in the above-mentioned second method and third method comprises a thermofusible inorganic material and a binder resin.

In this thermofusible toner, it is preferable that the amount ratio by weight of the thermofusible inorganic material be 1 wt. % or more, more preferably 5 wt. % or more, to the entire weight of the thermofusible toner. In particular, when the amount ratio by weight of the thermofusible inorganic material is 10 wt. % or more, the toner has sufficient fixing performance or fusibility to a heat resistant solid surface for use in practice.

Furthermore, it is preferable that the amount ratio by weight of the binder resin be 40 wt. % or more, more preferably 50 wt. % or more, to the entire weight of the thermofusible toner. In particular, when the amount ratio by weight of the binder resin is 60 wt. % or more, necessary characteristics for toner for use in electrophotography, such as stable chargeability and fixing performance, can be obtained.

The above-mentioned color toner and thermofusible toner can be produced by any of conventional methods which are employed in electrophotography. To such toners, conventionally employed auxiliary agents or additives such as a charge controlling agent can be added.

As such a charge controlling agent, there can be employed any of conventionally employed charge controlling agents, such as nigrosine dyes, triphenylmethane dyes, chromium-containing metal complex dyes, molybdic acid chelate dyes, rhodamine dyes, alkoxy amine, quaternary ammonium salt (including fluorine-modified quaternary ammonium salt), alkyl amide, phosphorus, phosphorus compound, tungsten, tungsten compound, fluorine-based activating agent, metal salicylate, and salicylic acid derivative metal salt.

These charge controlling agents can be employed alone or in combination.

The amount of such a charge controlling agent to be used in the toner depends upon the kind of a binder resin to be used in combination with the charge controlling agent, the presence or absence of an additive which is added to the toner when necessary, and also upon the method of producing the toner, including a dispersion method employed therein, and therefore cannot be determined unconditionally. However, it is preferable that the amount of such a charge controlling agent be 0.1 to 10 parts by weight, more preferably 2 to 5 parts by weight, to 100 parts by weight of a binder resin to be used in combination with the charge controlling agent, in order to obtain an appropriate charge quantity and sufficient chargeability for the toner for use in practice. To be more specific, when the amount of the charge controlling agent is less than 0.1 parts by weight to 100 parts by weight of a binder resin, the charge quantity of the toner tends to be insufficient, while when the amount of the charge controlling agent exceeds 10 parts by weight, the electrostatic attraction between a carrier and the toner tends to increase excessively so that the fluidity of the developer composed of the carrier and the toner is decreased and the image density tends to be decreased.

Examples of other additives that can be added to the toner include colloidal silica; hydrophobic silica; metal salts of aliphatic acids such as zinc stearate and aluminum stearate; metallic oxides such as titanium oxide, aluminum oxide, tin oxide, and antimony oxide; and fluoropolymer.

An image transfer medium for use in the present invention comprises an image formation film comprising a heat-vanishing material and/or a thermofusible inorganic material. The image formation film may also be a coated layer formed by a coating method as long as the film constitutes a toner image formation surface, and has no other restrictions thereto.

Such an image transfer medium for use in the present invention will now be explained with reference to FIGS. 1(*a*) to 3(*c*).

Figure 1B:
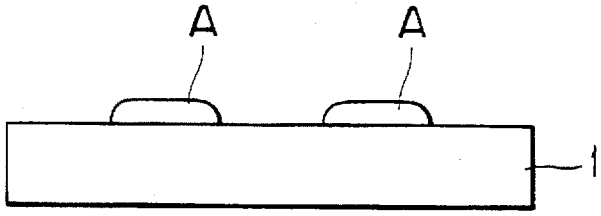

FIG. 1(*a*) shows an image transfer medium which essentially consists of a film 1 which comprises a heat-vanishing material and/or a thermofusible inorganic material. This film can be used as an image formation film.

A film comprising a heat-vanishing material, which may be referred to as a heat-vanishing film, is composed of a combustible material or a heat decomposable material.

Specific examples of such a heat-vanishing film include a non-expandable film, an expandable film, paper, synthetic paper, fabric, non-woven fabric, and glass-fiber-reinforced resin film.

Examples of a combustible material and a heat decomposable material include varieties of conventionally known synthetic resins such as thermoplastic resin and thermosetting resin, and natural resins and polymers.

It is preferable that such a heat-vanishing film have such a thickness that a dry type copying machine can form toner images thereon, namely a thickness of 30 to 200 μm, more preferably a thickness of 60 to 160 μm.

Furthermore, it is preferable that the heat-vanishing film generate no poisonous gases and have no adverse effects on image formation when burned or burned.

A film comprising a thermofusible inorganic material, which may be referred to as a thermofusible inorganic material film, is composed of a thermofusible inorganic material, which has preferably a fusing initiation temperature of 400° to 1200° C., more preferably a fusing initiation temperature of 500° to 1000° C.

As such a thermofusible inorganic material for use in the thermofusible inorganic material film, there can be employed, for example, the same thermofusible inorganic material as for use in the color toner for use in the present invention, such as a thermofusible inorganic material which is capable of forming a transparent vitreous solid when cooled after fused.

Thus, as such a thermofusible inorganic material film, a vitreous film itself can also be employed.

It is preferable that the thermofusible inorganic material film have such a thickness that exhibits sufficient flexibility for use in a dry type copying machine for the formation of toner images thereon, namely a thickness of 0.1 to 200 μm, more preferably a thickness of 60 to 160 μm.

When the thermofusible inorganic material film is too thin to handle with ease, it can be used by applying the film to a base paper.

Examples of a film comprising both the heat-vanishing material and the thermofusible inorganic material include a resin film provided with a surface film which comprises the thermofusible inorganic material, or with a thermofusible inorganic material layer as a surface film; and a film composed of an organic film made of a material such as paper, synthetic paper or unwoven fabric, and the thermofusible inorganic material which is coated on the organic film, or a film composed of the above-mentioned organic film which is impregnated with the thermofusible inorganic material.

It is preferable that the above-mentioned film which comprises both the heat-vanishing material and the thermofusible inorganic material have a thickness of 0.1 to 200 μm, more preferably a thickness of 60 to 160 μm.

As illustrated in FIG. 1(*a*), when the image transfer medium consists essentially of a film comprising the heat-vanishing material and/or thermofusible inorganic material in its entirety, one side of the image transfer medium constitutes an image formation surface on which a toner image is formed.

FIG. 1(*b*) is a schematic cross-sectional view of the image transfer medium shown in FIG. 1(*a*), on which toner images A are formed. The image transfer medium which bears such toner images A can be applied to the surface of a solid material by use of an adhesive agent or a tacky agent.

In this case, the image transfer medium is applied to the surface of the solid material in such a manner that the non-toner-image-bearing side thereof comes into contact with the surface of the solid material. Alternatively, the image transfer medium may be applied to the surface of the solid material in such a manner that the toner-image-bearing side thereof comes into contact with the surface of the solid material.

When the toner images A bearing image transfer medium is applied to the surface of the solid material in such a manner that the toner-image-bearing side thereof comes into contact with the surface of the solid material, care must be taken that mirror images are formed on the image transfer medium so that no reversed images are formed after burned. Mirror images are such images with the right and left sides reversed, which can be converted to normal images equal to the original images when transferred to an image receiving medium by an electrophotographic image formation process.

Figure 2A:
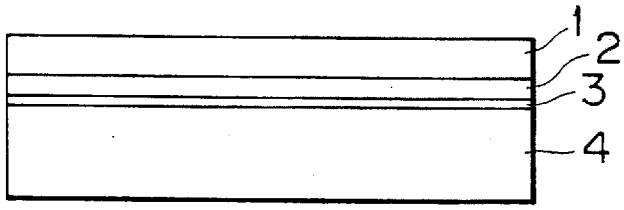
FIG. 2(*b*) is a schematic cross-sectional view of another example of an image transfer medium which bears toner images thereon of the present invention.
Figure 2B:
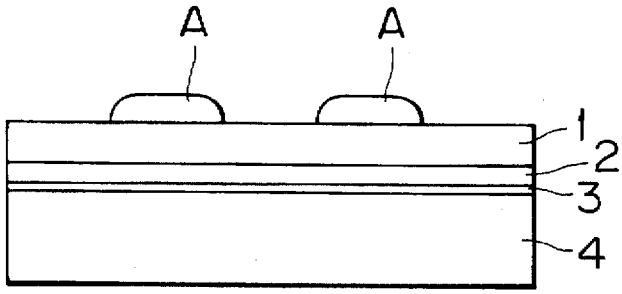

FIG. 2(*a*) shows another image transfer medium for use in the present invention, which comprises a base paper 4, a releasing agent layer 3 formed on the base paper 4, a tacky or adhesive agent layer 2 formed on the releasing agent layer 3, and a film 1 comprising the heat-vanishing material and/or the thermofusible inorganic material.

As the material for the base paper 4, there can be employed any materials without particular restriction, such as paper, synthetic paper, polymeric expandable or expanded film, nonwoven fabric, fabric, and fiber-reinforced resin film.

It is preferable that the base paper 4 have a thickness of 20 to 400 μm, more preferably a thickness of 40 to 100 μm.

The releasing agent layer 3 is far facilitating the peeling of the film 1 having the tacky or adhesive agent layer 2 off the base paper 4.

As a releasing agent for use in the releasing agent layer 3, there can be employed conventional releasing agents such as silicone resin, fluorine-containing resin, paraffin wax, and higher fatty acid.

It is preferable that the releasing agent layer 3 have a thickness of 0.1 to 10 μm, more preferably a thickness of 1 to 5 μm.

The tacky or adhesive agent layer 2 is for facilitating the sticking or adhesion of the film 1 peeled off the base paper 4 to the surface of a heat resistant solid.

Specific examples of a tacky or adhesive agent for use in the tacky or adhesive agent layer 2 are a hot-melt tacky agent; a water-soluble tacky agent; a solvent tacky agent; a rubber tacky agent; an acrylic tacky agent; an oligomer tacky agent; a curing tacky agent; water-activating tacky or adhesive agents, such as glue, gelatin, starch, dextrin, polyvinyl alcohol, and polyacrylic acid; and organic-solvent-activating tacky or adhesive agents including organic-solvent-soluble adhesive agents, and adhesive agents swelled by organic solvent.

It is preferable that the tacky or adhesive agent layer 2 have a thickness of 1 to 20 μm, more preferably 1 to 5 μm.

The film 1 comprising the heat-vanishing material and/or the thermofusible inorganic material constitutes a toner image formation surface. As a heat-vanishing material film, and/or a thermofusible inorganic material film, various films can be employed as explained with reference to the image transfer medium as shown in FIGS. 1(*a*) and 1(*b*).

It is preferable that the film 1 have a thickness of 0.1 to 50 μm, more preferably a thickness of 0.5 to 30 μm.

The image transfer medium with a structure that the image formation film 1 is overlaid on the base paper 4 and caused to adhere thereto, as illustrated in FIG. 2(*a*), is used for forming toner image on the surface of the film 1.

FIG. 2(*b*) is a schematic cross-sectional view of the image transfer medium shown in FIG. 2(*a*), on which toner images A are formed.

This image transfer medium which bears the toner images A can be applied to a solid surface by peeling the film 1 together with the tacky or adhesive agent layer 2 off the releasing agent layer 3 of the base paper 4, and can be fixed to the solid surface through the tacky or adhesive agent layer 2.

In the case of the image transfer medium as shown in FIGS. 2(*a*) and 2(*b*), when the tacky or adhesive agent layer 2 is a water-activating tacky or adhesive agent layer or an organic-solvent-activating tacky or adhesive agent layer, and the film 1 provided with such a tacky or adhesive agent layer 2 is applied to a solid surface, the tacky or adhesive agent layer 2 is brought into contact with water or an organic solvent to activate the tacky or adhesion performance of the layer 2, and the film 1 is overlaid on the solid surface and fixed thereto through the tacky or adhesive agent layer 2.

In the image transfer medium as shown in FIGS. 2(*a*), and 2(*b*), when a water-activating tacky or adhesive agent layer or an organic-solvent-activating tacky or adhesive agent layer is employed as the tacky or adhesive agent layer 2, the releasing agent layer 3 is not always necessary. This is because when the toner images A bearing image transfer medium as shown in FIG. 2(*b*) is brought into contact with water or an organic solvent in such a manner that at least the base paper 4 and the tacky or adhesive agent layer 2 are immersed into water or the organic solvent, the tacky or adhesive agent layer 2 is swollen or partly dissolved in water or the organic solvent, so that the film 1 can be easily peeled off the base paper 4.

Figure 3A:
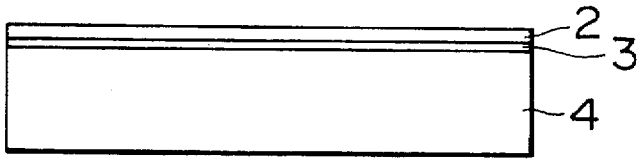
FIG. 3(*a*) is a schematic cross-sectional view of a further example of an image transfer medium which bears no toner images thereon of the present invention.
Figure 3B:
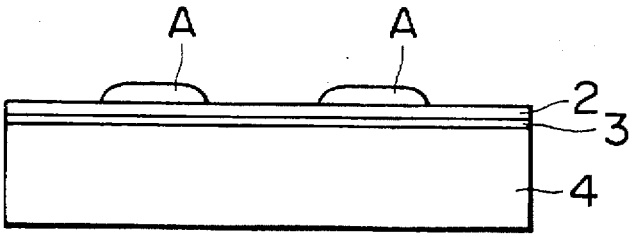
Figure 3C:
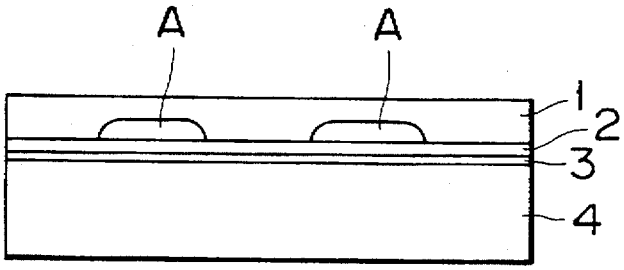

FIG. 3(*a*) is a schematic cross-sectional view of a further example of an image transfer medium of the present invention, which comprises a base paper 4, a releasing agent layer 3 formed thereon, and a tacky or adhesive agent layer 2 formed on the releasing agent layer 3. The tacky agent or adhesive agent layer 2 constitutes an image formation film layer serving as an image formation surface. In this case, as the base paper 4, and a releasing agent for the releasing agent layer 3, the same base paper and releasing agent as those employed in the image transfer medium as shown in FIG. 2(*a*) can be employed.

The tacky or adhesive agent layer 2 serving as an image formation surface may comprise a water-activating tacky or adhesive agent or an organic-solvent-activating tacky or adhesive agent. The tacky or adhesive agent layer 2 is in a dry state and exhibits no tacky or adhesive performance in a dry state, but a tacky or adhesive performance is imparted thereto when the tacky or adhesive agent layer 2 comes into contact with water or an organic solvent.

The tacky or adhesive agent layer 2 can be easily peeled away from the releasing agent layer 3 by bringing the tacky or adhesive agent layer 2 into contact with water or an organic solvent. It is preferable that the tacky or adhesive agent layer 2 have a thickness of 1 to 50 μm, more preferably a thickness of 2 to 20 μm.

The image transfer medium with a structure that the tacky or adhesive agent layer 2 is overlaid on the base paper 4 via the releasing agent layer 3, as illustrated in FIG. 3(*a*), is used for forming toner image on the surface of the tacky or adhesive agent layer 2.

FIG. 3(*b*) is a schematic cross-sectional view of the image transfer medium shown in FIG. 3(*a*), on which toner images A are formed.

In this image transfer medium which bears the toner images A on the tacky or adhesive agent layer 2, the tacky or adhesive agent layer 2 is peeled away in the form of a film from the releasing agent layer 3 for the base paper 4, and applied to a solid surface and fixed thereto.

When the tacky or adhesive agent layer 2 is peeled away from the releasing agent layer 3 for the base paper 4, if the tacky or adhesive agent layer 2 is as thin as 10 μm or less, particularly when its thickness is as thin as 2 to 5 μm, its handling is difficult. In such a case, it is preferable that a coating layer 1 selected from the group consisting of a layer comprising a thermofusible inorganic material and a thermofusible toner layer be formed on the tacky or adhesive agent layer 2 which bears toner images A thereon, before the peeling thereof as illustrated in FIG. 3(*c*), and that the tacky or adhesive agent layer 2 be peeled together with the coating layer 1 when the tacky or adhesive agent layer 2 is peeled away from the base paper 4.

A heat-vanishing film layer can be formed on the toner images A by various methods, such as a method of fusing a polymeric film on the surface of the toner images A; a method of applying a polymer fused liquid to the surface of the toner images A, and cooling the applied polymer fused liquid; a method of coating a solution or dispersion of a polymer on the surface of the toner images A and then drying the coated solution or dispersion; and a method of coating a curable resin liquid on the surface of the toner images A and curing the coated curable resin liquid. Such coating can be performed by spraying coating method.

It is preferable that the heat-vanishing film layer 1 have a thickness of 0.1 to 50 μm, more preferably a thickness of 0.5 to 30 μm.

As the polymeric material for the heat-vanishing film layer 1, for example, styrene resin, styrene—acrylic resin, polyamide resin, polyester resin, lower alkyl methacrylate resin, epoxy resin, and maleic acid resin can be employed. Of the above-mentioned polymeric materials, preferable polymeric materials are those which generate no poisonous gases and have no adverse effects on image formation when burned, in particular, styrene resin.

In the third method for forming a toner image layer comprising at least one colored toner image layer on an image formation film, with a thermofusible inorganic material layer or a thermofusible toner layer being provided on a color toner image layer, such as toner images A, the thermofusible inorganic material layer can be formed on the toner images A, for example, by a method of coating the toner images A with a paint comprising the thermofusible inorganic material in the form of finely-divided particles, and a binder resin dissolved or dispersed therein, and drying the coated paint; a method of coating the toner images A with an aqueous solution of an alkali metal silicate ($Na_2O.nSiO_2$, n=2 to 4) (water-glass) and drying the coated water-glass; and a method of applying a vitreous film to the toner images A by use of an adhesive.

It is preferable that the thermofusible inorganic material layer have a thickness of 1 to 500 μm, more preferably a thickness of 1 to 50 μm.

As the material for the thermofusible inorganic material layer, the same various thermofusible inorganic materials as for the color toner can be employed.

Furthermore, in the above-mentioned third method, the thermofusible toner layer can be formed on the toner images A, for example, by a method of preparing an image transfer medium which bears thereon the toner images A and forming a solid image on the toner images A by a dry type copying machine which uses a thermofusible toner;

and a method of forming a thin layer of a thermofusible toner on the toner images A, and applying pressure to the thin layer of the thermofusible toner at a temperature at which a binder resin contained in the thermofusible toner is melted.

It is preferable that the thermofusible toner layer have a thickness of 20 to 200 μm, more preferably a thickness of 40 to 100 μm.

In the image transfer medium which comprises a coating layer 1 on the above-mentioned toner images A, the coating layer 1, together with the tacky or adhesive agent layer 2 which bears the toner images A thereon, can be peeled away from the releasing agent layer 3 provided on the base paper 4, and can be applied to the surface of a heat resistant solid through the tacky or adhesive agent layer 2.

However, in the case where the toner images A are supported on the tacky or adhesive agent layer 2 and the materials for the tacky or adhesive agent layer 2 are not yet dissolved in water or an organic solvent, the tacky or adhesive agent layer 2 can be peeled away from the base paper 4 and applied to the surface of a heat resistant solid, without the formation of the coating layer 1 on the toner images A.

In the image transfer medium as shown in FIGS. 3(*a*), 3(*b*) and 3(*c*), when a water-activating tacky or adhesive agent layer or an organic-solvent-activating tacky or adhesive agent layer is employed as the tacky or adhesive agent layer 2, the releasing agent layer 3 is not always necessary. This is because when the toner images A bearing image transfer medium as shown in FIG. 3(*b*) is brought into contact with water or an organic solvent in such a manner that at least the base paper 4 and the tacky or adhesive agent layer 2 are immersed into water or the organic solvent, the tacky or adhesive agent layer 2 is swollen or partly dissolved in water or the organic solvent, so that the tacky or adhesive agent layer 2 can be easily peeled off the base paper 4 without the releasing agent layer 3.

The above-mentioned image transfer medium which comprises the heat-vanishing film overlaid on the base paper is commercially available as an image transfer medium for ceramic ware. Such a commercially available image transfer medium can also be employed in the present invention.

When paper is used as the base paper 4 for the image transfer media as shown in FIGS. 2(*a*), 2(*b*) and 3(*a*) to 3(*c*), a filling-up or sealing coat layer may be provided on the surface of the paper by a conventional method, in order to make the surface of the paper smooth to facilitate the provision of the releasing agent layer 3 or the tacky or adhesive agent layer 2 on the paper.

The second object of the present invention can be achieved by a first method of forming a colored image on a heat resistant solid surface comprising the steps of:

developing a latent electrostatic image with at least one color toner which comprises an inorganic coloring material and a binder resin to a colored toner image, transferring the colored toner image to a surface of an image formation film of an image transfer medium which comprises an image formation film comprising a heat-vanishing material and/or a thermofusible inorganic material at one time or a plurality of times in repetition;

fixing the colored toner image to the surface of the image formation film at least one time, thereby forming a toner-image-layer-bearing image formation film, with the toner image layer comprising at least one colored toner image layer; and overlaying the toner-image-layer-bearing image formation film on the heat resistant solid surface; and burning the toner-image-layer bearing image formation film in a temperature range in which the thermofusible inorganic material is fused.

In the above-mentioned method, the formation of the latent electrostatic image, development of the same to a colored image by use of a color toner to a colored toner image, and transfer of the developed colored toner image to the image transfer medium, to form at least one colored toner image on the image transfer medium, can be carried out by electrophotography.

In the above first method for the second object of the present invention, a color toner comprising an inorganic color material and a binder rain, without containing a thermofusible inorganic material, may be employed.

Such a color toner is particularly useful when subdued, not glossy, color images are desired.

On the other hand, glossy color images can be obtained by containing a thermofusible inorganic material to the color toner, or to the surface of the image transfer medium and/or the surface of the heat resistant solid.

In the above-mentioned first method for the second object of the present invention, a multi-color or full color image can be formed by use of a plurality of color toners, with a plurality of image transfer steps and at least one image fixing step.

The second object of the present invention can also be achieved by a second method of forming a colored image on a heat resistant solid surface comprising the steps of:

(I) preparing a toner-image-layer bearing image formation film by forming a toner image layer comprising at least one colored toner image layer and at least one thermofusible toner image layer on an identical image formation film, by use of process A and process B in combination, the process A comprising the steps of:

developing a latent electrostatic image with at least one color toner which comprises an inorganic coloring material and a binder resin to a colored toner image;

transferring the colored toner image to a surface of an image formation film of an image transfer medium which comprises an image formation film comprising a heat-vanishing material and/or a thermofusible inorganic material; and fixing the colored toner image to the surface of the image formation film to form a colored toner image layer thereon; and the process B comprising the steps of:

developing a latent electrostatic image with at least one thermofusible toner which comprises a thermofusible inorganic material which is capable of forming a transparent vitreous solid when cooled after fused, and a binder resin to a thermofusible toner image;

transferring the thermofusible toner image to the surface of the image formation film of the image transfer medium; and fixing the thermofusible toner image to the surface of the image formation film to form a thermofusible toner image layer thereon, thereby preparing a toner-image-layer bearing image formation film; and (II) overlaying the toner-image-layer-bearing image formation film on the heat resistant solid surface; and burning the toner-image-layer bearing image formation film in a temperature range in which the thermofusible inorganic material is melted.

In the above second method for achieving the second object of the present invention, the process A and the process B can be carried out by electrophotography.

More specifically, the formation of each latent electrostatic image, the development of each latent electrostatic image with each toner, the transfer of the developed toner images to the image transfer medium, the fixing of the developed toner images to the image transfer medium can be carried out by use of a dry type electrophotographic copying machine. In particular, the transfer of the toner images to the image transfer medium can be carried out by fusing the binder resin contained in each toner.

In order to obtain a colored-toner-image-layer bearing image transfer medium, as mentioned above, a toner image composed of the above-mentioned color toner is formed on the image transfer medium by use of an electrophotographic copying machine. In the electrophotographic copying process including the steps of formation of a latent electrostatic image, development thereof to a toner image, transfer of the developed toner image to the image transfer medium and fixing of the transferred toner image thereto, there are no particular restrictions to copying conditions such as process speed, charging potential, exposure potential, development gap, doctor blade gap, A.C. or D.C. development bias, and image transfer bias.

In order to obtain a thermofusible-toner-image-layer bearing image transfer medium, a toner image composed of the previously mentioned thermofusible toner corresponding to a predetermined original image is formed on a copy paper serving as the image transfer medium by use of an electrophotographic copying machine, and transferred to the copy paper. In this case, it is not always necessary that the thermofusible toner image correspond to the above-mentioned original image, but the thermofusible toner image may be a solid image. Such a solid image can be obtained by copying an original with a colored surface, such as a black surface, in its entirety.

According to the present invention, by repeating the above-mentioned copying operation by use of a predetermined toner, one or a plurality of colored toner image layers, and one or a plurality of thermofusible toner image layers can be formed on an identical image transfer medium.

In this case, the thermofusible toner image layer can be positioned as the uppermost layer or surface layer on the toner image layer formed on the image transfer layer, the innermost layer which is adjacent to the image transfer medium, and an intermediate layer between a plurality of colored toner image layers adjacent thereto.

In the present invention, when a toner image layer is overlaid on the surface of a solid, it is preferable that at least the thermofusible toner image layer be provided as the uppermost surface layer. When the thermofusible toner image layer provided as the uppermost surface layer is burned on the solid surface, a transparent vitreous layer formed by the fusing of the thermofusible toner covers the colored toner image layer, so that lustrous beautiful colored image can be formed on the solid surface.

When the thermofusible toner image layer is formed between a plurality of colored toner image layers, and burned on the solid surface, each thermofusible toner image layer clearly separates the plurality of colored toner images, so that the color tone of the inorganic coloring material contained in each colored toner image layer can be maintained, and therefore, the colored toner image obtained after burning is beautiful.

According to the present invention, a toner image layer can be formed on an image transfer medium, for example, by any of the following methods: (I) a method of forming one or a plurality of colored image layers on an image transfer medium; (ii) a method of forming one or a plurality of colored toner images and then a thermofusible toner image layer on an image transfer medium; (iii) a method of successively forming a thermofusible toner image layer, then one or a plurality of colored toner image layers, and then a thermofusible toner image layer on an image transfer medium; and (iv) a method of successively forming a thermofusible toner image layer, one or a plurality of colored toner image layers, a thermofusible toner image layer, one or a plurality of colored toner image layers, and then a thermofusible toner image layer on an image transfer medium.

In the above-mentioned methods, the thermofusible toner image layer may correspond not only to a specific original, but also to a solid image.

According to the present invention, an image transfer medium which bears thereon one or multi-color toner image layer, or a full color toner image layer can be prepared by use of a color copying machine.

When such an image transfer medium is obtained by use of a color copying machine, a yellow toner, a magenta toner, a cyan toner and a black toner, each of which is the previously mentioned inorganic toner, are used, and a copy paper for the copying machine is used as the image transfer medium, and an original which bears thereon a mono-color or multi-color image, or an original which bears a full color image is copied on the copy paper by the copying machine, whereby there can be obtained an image transfer medium which bears thereon one or multi-color toner image layer, or a full color toner image layer.

The full color toner image layer is composed of a yellow toner image layer, a magenta toner image layer, a cyan toner image layer and a black toner image layer.

The second object of the present invention can be achieved by a third method of forming a colored image on a heat resistant solid surface comprising the steps of:

(I) preparing a toner-image-bearing image formation film by forming a toner image layer comprising at least one colored toner image layer on an image formation film, with a thermofusible inorganic material layer or a thermofusible toner layer being provided on the color toner image layer, comprising the steps of;

developing a latent electrostatic image with at least one color toner which comprises an inorganic coloring material and a binder resin to a colored toner image;

transferring the colored toner image to a surface of an image formation film of an image transfer medium which comprises an image formation film comprising a heat-vanishing material and/or a thermofusible inorganic material;

fixing the colored toner image to the image formation film at least one time to form a colored toner image layer on the image formation film; and forming a thermofusible inorganic material layer comprising a thermofusible inorganic material capable of forming a transparent vitreous solid when cooled after fused, or a thermofusible toner layer comprising the thermofusible inorganic material and a binder resin, on the color toner image layer, thereby preparing a toner-image-bearing image formation film; and (II) overlaying the toner-image-layer-bearing image formation film on the heat resistant solid surface; and burning the toner-image-layer bearing image formation film in a temperature range in which the thermofusible inorganic material is melted.

As mentioned above, in the third method for achieving the second object of the present invention, a thermofusible material layer or a thermofusible toner layer, which is capable of forming a transparent vitreous solid when cooled after fused, is formed so as to cover a toner image layer formed on an image transfer medium.

It is preferable that the thermofusible material layer or the thermofusible toner layer, serving as a coating layer for the toner image layer, cover the entire surface of the toner image layer.

In the above-mentioned third method for achieving the second object of the present invention, the thermofusible inorganic material layer can be formed on the toner images A, for example, by a method of coating the toner images A with a paint comprising the thermofusible inorganic material in the form of finely-divided particles, and a binder resin dissolved or dispersed therein, and drying the coated paint; a method of coating the toner images A with an aqueous solution of an alkali metal silicate ($Na_2O.nSiO_2$, n=2 to 4) (water-glass) and drying the coated water-glass; and a method of applying a vitreous film to the toner images A by use of an adhesive.

It is preferable that the thermofusible inorganic material layer have a thickness of 1 to 500 μm, more preferably a thickness of 1 to 50 μm.

Furthermore, in the above-mentioned third method, the thermofusible toner layer can be formed on the toner images A, for example, by a method of preparing an image transfer medium which bears thereon the toner images A and forming a solid image on the toner images A by a dry type copying machine which uses a thermofusible toner and a copy paper serving as the image transfer medium; and a method of forming a thin layer of a thermofusible toner on the toner images A, and applying pressure to the thin layer of the thermofusible toner at a temperature at which a binder resin contained in the thermofusible toner is melted.

The image transfer medium comprising a film surface which comprises the heat-vanishing material and/or the thermofusible inorganic material, with a toner image layer being formed on the film surface, can be prepared by the above-mentioned various methods.

It is not always necessary to apply the toner-image-layer bearing image transfer medium to the surface of a heat resistant solid and to burn the same immediately after the preparation of the toner-image-layer bearing image transfer medium. The toner-image-layer bearing image transfer medium can be preserved for later use or can be marketed as an independent product.

A process for applying the thus prepared toner-image-layer bearing image transfer medium or film to the surface of a heat resistant solid and then burning the applied image transfer medium for the formation of the toner image on the body of the heat resistant solid will now be explained.

When the image transfer medium consists essentially of a heat-vanishing film and/or a thermofusible inorganic material film as illustrated in FIGS. 1(*a*) and 1(*b*), the image transfer medium is applied to the surface of the heat resistant solid by use of a tacky or adhesive agent.

However, when the image transfer medium comprises a base paper and a toner-image bearing image formation film layer comprising a heat-vanishing film and/or a thermofusible inorganic material film provided on the base paper through a tacky or adhesive agent layer as illustrated in FIGS. 2(*a*) and 2(*b*), the toner-image bearing film layer is peeled away from the base paper, and applied to the surface of the heat resistant solid through the tacky or adhesive agent layer.

Furthermore, when the image transfer medium comprises a base paper and a tacky or adhesive agent layer which comprises a heat-vanishing material and/or a thermofusible inorganic material, in the form of a film layer, provided on the base paper, as illustrated in FIGS. 3(*a*) and 3(*b*), if necessary, with the provision of a coating layer 1 on the tacky or adhesive agent layer as illustrated in FIG. 3(*c*), the tacky or adhesive agent layer 2 is brought into contact with water or an organic solvent and then peeled away from the releasing agent layer 3 provided on the base paper 4, together with the coating layer 1 when provided, and then applied to the surface of a heat resistant solid.

The toner-image-layer bearing image transfer medium or film, applied to the surface of a heat resistant solid, is then burned. The burning temperature is in the range in which the thermofusible materials contained in the image transfer medium or film and the toner image formed thereon are entirely fused to form a vitreous solid when cooled after the fusion.

The heat resistant solid for use in the present invention has such a surface that the above-mentioned toner image formed on the image transfer medium or film does not disappear when burned on the surface.

Examples of such a surface of a heat resistant solid include a solid surface made of glass, a solid surface made of a heat resistant metal or alloy, and a solid surface made of ceramics.

Examples of a product with the surface thereof comprising glass are pottery with a surface made of tile, porcelain enamel or glaze; and heat resistant glass.

Examples of a product with the surface thereof comprising a heat resistant metal or alloy are metal products made of titanium, zirconium, molybdenum, tungsten, iron, nickel, cobalt, vanadium, aluminum, copper, silver, vanadium, gold, platinum, or stainless steel.

Examples of products made of ceramics are products made of ceramic glass, pottery, stone, clay or cement.

It is preferable that a heat resistant solid surface for use in the present invention have high degree of whiteness for the formation of clear images thereon.

It is preferable that the heat resistant solid surface have a reflectivity of 93% or more, more preferably 98% or more, with respect to the light with a wavelength of 450 to 800 nm.

It is also preferable that the heat resistant solid surface be smooth as much as possible, namely 5 μm or less, more preferably 1 μm or less, in terms of the surface 10-point average roughness Rz.

Furthermore, it is preferable that the heat resistant solid surface for use in the present invention be, partly or in its entirety, covered with the previously mentioned thermofusible inorganic material, or comprise the thermofusible inorganic material.

When the heat resistant solid surface is covered with the thermofusible inorganic material in the form of coating layer, it is preferable that the coating layer have a thickness of 1 to 20 μm, more preferably 3 to 10 μm.

The heat resistant solid surface which is covered with the thermofusible inorganic material or which contains the heat resistant solid surface is effective for fixing an inorganic-coloring-material containing toner thereto by burning or baking.

It is not always necessary that the product having a heat resistant solid surface be made of a heat resistant solid in its entirety, but a product with only a surface portion thereof being made of a heat resistant solid can be employed in the present invention.

The product having a heat resistant solid surface may be such a product whose surface is coated with a vitreous layer.

A product having such a vitreous surface layer has the advantage over other products that a toner-image layer can be easily transferred to the product since when a toner-image-layer bearing image transfer medium or film is overlaid on the surface layer and burned, the vitreous surface layer can be fused.

As an apparatus for burning the toner-image-layer bearing image transfer medium or film applied to the heat resistant solid surface, any apparatus can be employed as long as it is capable of heating the image transfer medium and the heat resistant solid surface at sufficiently high temperatures for fusing the thermofusible material contained therein.

Examples of such a heating apparatus are burning furnace for the production of pottery, electric furnace, other furnace using petroleum or gases as a heat source therefor, dielectric furnace, and microwave furnace.

It is preferable that the heating apparatus be such that the reducing and oxidizing conditions, and burning temperature can be easily controlled.

Other features of this invention will become apparent in the course of the following description of exemplary embodiments, which are given for illustration of the invention and are not intended to be limiting thereof.

Production Example 1-1

[Production of Thermofusible Inorganic Material A]

A mixture of the following components was pulverized in a stamp mill and was then mixed in a Henschel mixer, whereby a thermofusible inorganic material A was prepared:

| | Parts by Weight |
|---|---|
| PbO | 80 |
| $B_2O_3$ | 20 |

Production Example 1-2

[Production of Thermofusible Inorganic Material B]

A mixture of the following components was pulverized in a stamp mill and was then mixed in a Henschel mixer, whereby a thermofusible inorganic material B was prepared;

| | Parts by Weight |
|---|---|
| PbO | 70 |
| $B_2O_3$ | 15 |
| $SiO_2$ | 15 |

Production Example 1-3

[Production of Thermofusible Inorganic Material C]

A mixture of the following components was pulverized in a stamp mill and was then mixed in a Henschel mixer, whereby a thermofusible inorganic material C was prepared:

| | Parts by Weight |
|---|---|
| $Na_2O$ | 1 |
| $K_2O$ | 2 |
| CaO | 15 |
| PbO | 2 |
| $B_2O_3$ | 13 |
| $Al_2O_3$ | 2 |
| $SiO_2$ | 35 |

Production Example 1-4

[Production of Thermofusible Inorganic Material D]

A mixture of the following components was pulverized in a stamp mill and was then mixed in a Henschel mixer, whereby a thermofusible inorganic material C was prepared:

| | Parts by Weight |
|---|---|
| PbO | 70 |
| $B_2O_3$ | 20 |
| CaO | 10 |

Production Example 2-1

[Production of Color Toner A-1 (Black Toner)]

A mixer of the following components was mixed in a mixer, and fused and kneaded in a two-roll mill:

| | Parts by Weight |
|---|---|
| Polyester resin (Acid value = 3, Hydroxyl value = 25, Mn = 45000, Mw/Mn = 4.0, Tg = 60° C.) | 100 |
| (Mn, Co)O.(Cr, Fe)$_2$O$_3$ | 18 |
| Zinc salicylate derivative (Trademark "Bontron E84" made by Orient Chemical Industries, Ltd.) | 3 |

The above kneaded mixture was roll-cooled, pulverized and classified, whereby a toner with a volume mean diameter of 7.5 μm was obtained.

To 100 parts by weight of this toner, 0.5 parts by weight of a commercially available hydrophobic silica (Trademark "R972" made by Nippon Aerosil Co., Ltd.) was added, and the mixture was mixed in a mixer, whereby color toner A-1 was prepared.

Production Example 2-2

[Production of Color Toner A-2 (Black Toner)]

A mixture of the following components was mixed in a mixer, and fused and kneaded in a two-roll mill:

| | Parts by Weight |
|---|---|
| Polyester resin (Acid value = 3, Hydroxyl value = 25, Mn = 45000, Mw/Mn = 4.0, Tg = 60° C.) | 100 |

-continued

| | Parts by Weight |
|---|---|
| (Mn, Co)O.(Cr, Fe)$_2$O$_3$ | 18 |
| Thermofusible inorgainc material A produced in Production Example 1-1 | 80 |
| Zinc salicylate derivative (Trademark "Bontron E84" made by Orient Chemical Industries, Ltd.) | 3 |

The above kneaded mixture was roll-cooled, pulverized and classified, whereby a toner with a volume mean diameter of 7.5 μm was obtained.

To 100 parts by weight of this toner, 0.5 parts by weight of a commercially available hydrophobic silica (Trademark "R972" made by Nippon Aerosil Co., Ltd.) was added, and the mixture was mixed in a mixer, whereby color toner A-2 was prepared.

Production Example 2-3

[Production of Color Toner A-3]

A mixture of the following components was mixed in a mixer, and fused and kneaded in a two-roll mill:

| | Parts by Weight |
|---|---|
| Polyester resin (Acid value = 3, Hydroxyl value = 25, Mn = 45000, Mw/Mn = 4.0, Tg = 60° C.) | 100 |
| Manganese Pink | 18 |
| Thermofusible inorgainc material B produced in Production Example 1-2 | 80 |
| Zinc salicylate derivative (Trademark "Bontron E84" made by Orient Chemical Industries, Ltd.) | 3 |

The above kneaded mixture was roll-cooled, pulverized and classified, whereby a toner with a volume mean diameter of 7.5 μm was obtained.

To 100 parts by weight of this toner, 0.5 parts by weight of a commercially available hydrophobic silica (Trademark "R972" made by Nippon Aerosil Co., Ltd.) was added, and the mixture was mixed in a mixer, whereby color toner A-3 was prepared.

Production Example 2-4

[Production of Color Toner A-4 (Blue Toner)]

A mixture of the following components was mixed in a mixer, and fused and kneaded in a two-roll mill:

| | Parts by Weight |
|---|---|
| Polyester resin (Acid value = 3, Hydroxyl value = 25, Mn = 45000, Mw/Mn = 4.0, Tg = 60° C.) | 60 |
| (Zn, Co)O.Al$_2$O$_3$ | 15 |
| Thermofusible inorgainc material D produced in Production Example 1-4 | 80 |
| Zinc salicylate derivative (Trademark "Bontron E84" made by Orient Chemical Industries, Ltd.) | 3 |

The above kneaded mixture was roll-cooled, pulverized and classified, whereby a toner with a volume mean diameter of 7.5 μm was obtained.

To 100 parts by weight of this toner, 0.5 parts by weight of a commercially available hydrophobic silica (Trademark "R972" made by Nippon Aerosil Co., Ltd.) was added, and the mixture was mixed in a mixer, whereby color toner A-4 was prepared.

Production Example 2-5

[Production of Color Toner A-5 (Black Toner)]

A mixture of the following components was mixed in a mixer, and fused and kneaded in a three-roll mill through 3 paths:

| | Parts by Weight |
|---|---|
| Polyester resin (Acid value = 3, Hydroxyl value = 25, Mn = 45000, Mw/Mn = 4.0, Tg = 60° C.) | 600 |
| (Mn, Co)O.(Cr, Fe)$_2$O$_3$ | 100 |
| Thermofusible inorgainc material C produced in Production Example 1-3 | 300 |
| Zinc salicylate derivative (Trademark "Bontron E84" made by Orient Chemical Industries, Ltd.) | 2 |

The above kneaded mixture was cooled, pulverized by a pulverizer, finely divided by a jet mill, and classified, whereby a toner with a volume mean diameter of 7.5 μm was obtained.

To 100 parts by weight of this toner, 0.5 parts by weight of a commercially available hydrophobic silica (Trademark "R972" made by Nippon Aerosil Co., Ltd.) was added, and the mixture was mixed in a mixer, whereby color toner A-5 was prepared.

Production Example 2-6

[Production of Color Toner A-6 (Yellow Toner)]

A mixture of the following components was mixed in a mixer, and fused and kneaded in a three-roll mill through 3 paths;

| | Parts by Weight |
|---|---|
| Polyester resin (Acid value = 3, Hydroxyl value = 25, Mn = 45000, Mw/Mn = 4.0, Tg = 60° C.) | 600 |
| Chromium Titanium yellow | 100 |
| Thermofusible inorgainc material C produced in Production Example 1-3 | 300 |
| Zinc salicylate derivative (Trademark "Bontron E84" made by Orient Chemical Industries, Ltd.) | 2 |

The above kneaded mixture was cooled, pulverized by a pulverizer, finely divided by a jet mill, and classified, whereby a toner with a volume mean diameter of 7.5 μm was obtained.

To 100 parts by weight of this toner, 0.5 parts by weight of a commercially available hydrophobic silica (Trademark "R972" made by Nippon Aerosil Co., Ltd.) was added, and the mixture was mixed in a mixer, whereby color toner A-6 was prepared.

Production Example 2-7

[Production of Color Toner A-7 (Red Toner)]

A mixture of the following components was mixed in a mixer, and fused and kneaded in a three-roll mill through 3 paths:

| | Parts by Weight |
|---|---|
| Polyester resin (Acid value = 3, Hydroxyl value = 25, Mn = 45000, Mw/Mn = 4.0, Tg = 60° C.) | 600 |
| $ZnO.(Al, Cr)_2O_3$ | 100 |
| Thermofusible inorgainc material C produced in Production Example 1-3 | 300 |
| Zinc salicylate derivative (Trademark "Bontron E84" made by Orient Chemical Industries, Ltd.) | 2 |

The above kneaded mixture was cooled, pulverized by a pulverizer, finely divided by a jet mill, and classified, whereby a toner with a volume mean diameter of 7.5 μm was obtained.

To 100 parts by weight of this toner, 0.5 parts by weight of a commercially available hydrophobic silica (Trademark "R972" made by Nippon Aerosil Co., Ltd.) was added, and the mixture was mixed in a mixer, whereby color toner A-7 was prepared.

Production Example 2-8

[Production of Color Toner A-8 (Blue Toner)]

A mixture of the following components was mixed in a mixer, and fused and kneaded in a three-roll mill through 3 paths:

| | Parts by Weight |
|---|---|
| Polyester resin (Acid value = 3, Hydroxyl value = 25, Mn = 45000, Mw/Mn = 4.0, Tg = 60° C.) | 600 |
| Vanadium Blue | 100 |
| Thermofusible inorgainc material C produced in Production Example 1-3 | 300 |
| Zinc salicylate derivative (Trademark "Bontron E84" made by Orient Chemical Industries, Ltd.) | 2 |

The above kneaded mixture was cooled, pulverized by a pulverizer, finely divided by a jet mill, and classified, whereby a toner with a volume mean diameter of 7.5 μm was obtained.

To 100 parts by weight of this toner, 0.5 parts by weight of a commercially available hydrophobic silica (Trademark "R972" made by Nippon Aerosil Co., Ltd.) was added, and the mixture was mixed in a mixer, whereby color toner A-8 was prepared.

Production Example 2-9

[Production of Color Toner A-9]

A mixture of the following components was mixed in a mixer, and fused and kneaded in a two-roll mill:

| | Parts by Weight |
|---|---|
| Polyester resin (Acid value = 3, Hydroxyl value = 25, Mn = 45000, Mw/Mn = 4.0, Tg = 60° C.) | 600 |
| $(Mn, Co)O.(Cr, Fe)_2O_3$ | 40 |
| Zinc salicylate derivative (Trademark "Bontron E84" made by Orient Chemical Industries, Ltd.) | 3 |

The above kneaded mixture was roll-cooled, pulverized and classified, whereby a toner with a volume mean diameter of 7.5 μm was obtained.

To 100 parts by weight of this toner, 5 parts by weight of a commercially available hydrophobic silica (Trademark "R972" made by Nippon Aerosil Co., Ltd.) was added, and the mixture was mixed in a mixer, whereby color toner A-9 was prepared.

Production Example 2-10

[Production of Color Toner A-10 (Yellow Toner)]

A mixture of the following components was mixed in a mixer, and fused and kneaded in a three-roll mill through 3 paths:

| | Parts by Weight |
|---|---|
| Polyester resin (Acid value = 3, Hydroxyl value = 25, Mn = 45000, Mw/Mn = 4.0, Tg = 65° C.) | 600 |
| Chromium Titanium yellow | 200 |
| Zinc salicylate derivative (Trademark "Bontron E84" made by Orient Chemical Industries, Ltd.) | 2 |

The above kneaded mixture was cooled, pulverized by a pulverizer, finely divided by a jet mill, and classified, whereby a toner with a volume mean diameter of 7.5 μm was obtained.

To 100 parts by weight of this toner, 0.5 parts by weight of a commercially available hydrophobic silica (Trademark "R972" made by Nippon Aerosil Co., Ltd.) was added, and the mixture was mixed in a mixer, whereby color toner A-10 was prepared.

Production Example 2-11

[Production of Color Toner A-11 (magenta Toner)]

A mixture of the following components was mixed in a mixer, and fused and kneaded in a three-roll mill through 3 paths:

| | Parts by Weight |
|---|---|
| Polyester resin (Acid value = 3, Hydroxyl value = 25, Mn = 45000, Mw/Mn = 4.0, Tg = 65° C.) | 600 |
| $ZnO.(Al, Cr)_2O_3$ | 200 |
| Zinc salicylate derivative (Trademark "Bontron E84" made by Orient Chemical Industries, Ltd.) | 2 |

The above kneaded mixture was cooled, pulverized by a pulverizer, finely divided by a jet mill, and classified, whereby a toner with a volume mean diameter of 10 μm was obtained.

To 100 parts by weight of this toner, 0.5 parts by weight of a commercially available hydrophobic silica (Trademark "R972" made by Nippon Aerosil Co., Ltd.) was added, and the mixture was mixed in a mixer, whereby color toner A-11 was prepared.

Production Example 2-12

[Production of Color Toner A-12 (Cyan Toner)]

A mixture of the following components was mixed in a mixer, and fused and kneaded in a three-roll mill through 3 paths;

| | Parts by Weight |
|---|---|
| Polyester resin (Acid value = 3, Hydroxyl value = 25, Mn = 45000, Mw/Mn = 4.0, Tg = 65° C.) | 600 |
| Vanadium Blue | 200 |
| Zinc salicylate derivative (Trademark "Bontron E84" made by Orient Chemical Industries, Ltd.) | 2 |

The above kneaded mixture was cooled, pulverized by a pulverizer, finely divided by a jet mill, and classified, whereby a toner with a volume mean diameter of 10 μm was obtained.

To 100 parts by weight of this toner, 0.5 parts by weight of a commercially available hydrophobic silica (Trademark "R972" made by Nippon Aerosil Co., Ltd.) was added, and the mixture was mixed in a mixer, whereby color toner A-12 was prepared.

Production Example 3-1

[Production of Thermofusible Toner B-1]

A mixture of the following components was mixed in a mixer, and fused and kneaded in a two-roll mill:

| | Parts by Weight |
|---|---|
| Polyester resin (Acid value = 3, Hydroxyl value = 25, Mn = 45000, Mw/Mn = 4.0, Tg = 60° C.) | 100 |
| Glass flux (Trademark "10034" made by Degussa Japan Co., Ltd.) | 48 |
| Zinc salicylate derivative (Trademark "Bontron E84" made by Orient Chemical Industries, Ltd.) | 3 |

The above kneaded mixture was roll-cooled, pulverized and classified, whereby a toner with a volume mean diameter of 7.5 μm was obtained.

To 100 parts by weight of this toner, 5.0 parts by weight of a commercially available hydrophobic silica (Trademark "R972" made by Nippon Aerosil Co., Ltd.) was added, and the mixture was mixed in a mixer, whereby thermofusible toner B-1 was prepared.

Production Example 3-2

[Production of Thermofusible Toner B-2]

The procedure of producing Thermofusible Toner B-1 in Production Example 3-1 was repeated except that the glass flux employed in Production Example 3-1 was replaced by the thermofusible inorganic material A produced in Production Example 1-1, whereby thermofusible toner B-2 was produced.

Production Example 3-4

[Production of Thermofusible Toner B-4]

The procedure of producing Thermofusible Toner B-1 in Production Example 3-1 was repeated except that the glass flux employed in Production Example 3-1 was replaced by the thermofusible inorganic material C produced in Production Example 1-3, whereby thermofusible toner B-4 was produced.

Production Example 3-5

[Production of Thermofusible Toner B-5]

The procedure of producing Thermofusible Toner B-1 in Production Example 3-1 was repeated except that the glass flux employed in Production Example 3-1 was replaced by the thermofusible inorganic material D produced in Production Example 1-4, whereby thermofusible toner B-5 was produced.

Production Example 4

[Production of Carrier A]

The following components were dispersed in a homomixer for 30 minutes, whereby a coating layer formation liquid was prepared;

| | Parts by Weight |
|---|---|
| Silicone resin (Trademark "KR50" made by Shin-Etsu Chemical Co., Ltd.) | 100 |
| Carbon black (Trademark "BP2000" made by Cabot Corporation) | 3 |
| Toluene | 100 |

The above prepared the coating layer formation liquid was coated on 1000 parts by weight of spherical ferrite particles with an average particle diameter of 50 μm in a fluidized bed type coating apparatus to provide a coating layer on the spherical ferrite particles, whereby carrier A was prepared.

EXAMPLE 1

A mixture of 1000 g of carrier A prepared in Production Example 4 and 25 g of color toner A-1 prepared in Production Example 2-1 was stirred in a ball mill for 30 minutes, whereby a developer was obtained.

The thus prepared developer was incorporated in a commercially available dry type copying machine (Trademark "Imagio MF530" made by Ricoh Company, Ltd.), and a toner image was formed on a commercially available transfer sheet for pottery (Trademark "OK Series SN-100" made by Nittoshiko Co., Ltd.), which is of the same type as that of the image transfer medium as illustrated in FIG. 3(*a*), but without a releasing agent layer, comprising a base paper made of a non-sized paper with a sizing layer made of a cold-water-insoluble starch, and a sticky adhesive agent layer comprising a cold-water-soluble dextrin.

The thus prepared toner-image-bearing image transfer sheet was immersed into an aqueous dispersion of thermofusible inorganic material C prepared in Production Example 1-3. When the sticky adhesive agent layer began to be dissolved in the aqueous dispersion, the toner-image-bearing image transfer sheet was pulled out of the aqueous dispersion, and was then applied to a sufficiently dried, commercially available tile (Trademark "RS-252" made by INAX Co., Ltd.).

The base paper was then peeled away from the image transfer sheet, and the image transfer sheet applied tile was then burned at 900° C. for 1 hour.

The burned tile was gradually cooled. It was observed that a black color image was formed on the tile, although the black color image was slightly dull.

EXAMPLE 2

A mixture of 1000 g of carrier A prepared in Production Example 4 and 25 g of color toner A-2 prepared in Production Example 2-2 was stirred in a ball mill for 30 minutes, whereby a developer was obtained.

The thus prepared developer was incorporated in a commercially available dry type copying machine (Trademark "Imagio MF530" made by Ricoh Company, Ltd.), and a toner image was formed on an image transfer sheet composed of a commercially available "hakushi" Kent paper, made by The Japan Paper Industry Co., Ltd., a thin gum arabic layer formed thereon, and an ethyl cellulose layer with a thickness of 20 μm formed on the gum arabic layer.

The thus prepared toner-image-bearing image transfer sheet was immersed into water, and was then applied to a sufficiently dried, commercially available tile (Trademark "RS-252" made by INAX Co., Ltd.) in the same manner as in Example 1.

The base paper was then peeled away from the image transfer sheet, and the image transfer sheet applied tile was then burned at 900° C. for 1 hour.

The burned tile was then gradually cooled. It was observed that a glossy black color image was formed on the tile.

EXAMPLE 3

A mixture of 1000 g of carrier A prepared in Production Example 4 and 25 g of color toner A-3 prepared in Production Example 2-3 was stirred in a ball mill for 30 minutes, whereby a first developer was obtained.

The thus prepared first developer was incorporated in a commercially available dry type copying machine (Trademark "Imagio MF530" made by Ricoh Company, Ltd.), and a first toner image was formed on an image transfer sheet composed of a commercially available "hakushi" Kent paper, made by The Japan Paper Industry Co., Ltd., a thin gum arabic layer formed thereon, and an ethyl cellulose layer with a thickness of 20 μm formed on the gum arabic layer.

A mixture of 1000 g of carrier A prepared in Production Example 4 and 25 g of color toner A-4 prepared in Production Example 2-4 was stirred in a ball mill for 30 minutes, whereby a second developer was obtained.

The first developer incorporated in the dry type copying machine was replaced by the above prepared second developer, and a second toner image was formed on the same image transfer medium by the dry type copying machine in such a manner that the second toner image was partly superimposed on the first toner image.

The thus prepared first and second toner-images-bearing image transfer sheet was immersed into water, and was then applied to a sufficiently dried, commercially available tile (Trademark "RS-252" made by INAX Co., Ltd.) in the same manner as in Example 1.

The base paper was then peeled away from the image transfer sheet, and the image transfer sheet applied tile was then burned at 900° C. for 1 hour.

The burned tile was then gradually cooled. It was observed that a glossy red color image, a glossy blue color image were formed on the tile, and an overlapping portion of the red color image and the blue color image was purple.

EXAMPLE 4

A mixture of 400 g of carrier A prepared in Production Example 4 and 20 g of color toner A-5 prepared in Production Example 2-5 was stirred in a ball mill for 30 minutes, whereby a black developer was obtained.

The thus prepared black developer was incorporated in a black color development section of a commercially available color copying machine (Trademark "PRETER 550" made by Ricoh Company, Ltd.).

A mixture of 400 g of carrier A prepared in Production Example 4 and 20 g of color toner A-6 prepared in Production Example 2-6 was stirred in a ball mill for 30 minutes, whereby a yellow developer was obtained.

The thus prepared yellow developer was incorporated in a yellow color development section of the above-mentioned color copying machine.

A mixture of 400 g of carrier A prepared in Production Example 4 and 20 g of color toner A-7 prepared in Production Example 2-7 was stirred in a ball mill for 30 minutes, whereby a magenta developer was obtained.

The thus prepared magenta developer was incorporated in a magenta color development section of the abovementioned color copying machine.

A mixture of 400 g of carrier A prepared in Production Example 4 and 20 g of color toner A-8 prepared in Production Example 2-8 was stirred in a ball mill for 30 minutes, whereby a cyan developer was obtained.

The thus prepared cyan developer was incorporated in a cyan color development section of the above-mentioned color copying machine.

A multi-color toner image was formed on a commercially available transfer sheet for pottery (Trademark "OK Series SN-100" made by Nittoshiko Co., Ltd.) by the color copying machine, whereby a multicolor-toner image bearing image transfer medium was prepared.

The thus prepared multi-color-toner image bearing image transfer medium was immersed into water, and was then applied to a sufficiently dried, commercially available tile (Trademark "RS-252" made by INAX Co., Ltd.) in the same manner as in Example 1.

The base paper was then peeled away from the image transfer medium, and the image transfer sheet applied tile was then burned at 900° C. for 1 hour.

The burned tile was then gradually cooled. It was observed that a glossy multi-color image was formed on the tile.

EXAMPLE 5

[Toner Image Formation by Use of Color Toner]

A mixture of 1000 g of carrier A prepared in Production Example 4 and 25 g of color toner A-9 prepared in Production Example 2-9 was stirred in a ball mill for 30 minutes, whereby a developer was obtained.

The thus prepared developer was incorporated in a commercially available dry type copying machine (Trademark "Imagio MP530" made by Ricoh Company, Ltd.), and a colored toner image was formed on a commercially available transfer sheet for pottery (Trademark "OR Series SN-100" made by Nittoshiko Co., Ltd.).

[Image Formation by Use of Thermofusible Toner]

A mixture of 1000 g of carrier A prepared in Production Example 4 and 25 g of thermofusible toner B-1 prepared in Production Example 3-1 was stirred in a ball mill for 30 minutes, whereby a developer was obtained.

The thus prepared developer was incorporated in another commercially available dry type copying machine (Trademark "Imagio XF530" made by Ricoh Company, Ltd.), and a solid thermofusible toner image was formed on the entire surface of the image area of the above-mentioned transfer sheet for pottery (Trademark "OK Series SN-100" made by Nittoshiko Co., Ltd.) so as to cover the previously formed toner image in its entirety.

The thus formed colored toner image and the solid thermofusible toner image bearing image transfer medium, was sprayed with a xylene solution of polystyrene, whereby a polystyrene film serving as a protective layer was formed on the toner image bearing side of the image transfer medium, so that a toner image layer was formed.

The thus prepared image transfer medium was immersed into water, and the toner image layer was peeled away from the image transfer medium. The thus peeled toner image layer was then applied to a commercially available white tile (Trademark "SP150" made by INAX Co., Ltd.).

The toner image layer applied tile was then sufficiently dried and burned at 900° C. for 1 hour in an electric furnace.

The burned tile was then gradually cooled. It was observed that a glossy black image was formed on the tile.

The development conditions for the formation of the above-mentioned toner image on the image transfer medium were as follows:

| | |
|---|---|
| Process speed: | 180 mm/sec |
| Charging potential: | −650 V |
| Exposure potential: | −100 V |
| Development gap: | 0.6 mm |
| Doctor gap: | 0.45 mm |
| Linear speed ratio with respect to photoconductor: | 1.5 |
| Development bias: | AC (p-p 1 KV) + DC (−500 V) |
| Belt transfer bias: | 1400 V |
| Paper transfer bias: | 1300 V |

EXAMPLE 6

The procedure for forming the colored image on the tile in Example 5 was repeated except that the thermofusible toner B-1 employed in Example 5 was replaced by the thermofusible toner B-2 prepared in Production Example 3-2, whereby a black image was formed on the tile.

The thus obtained black image, however, was slightly dull.

EXAMPLE 7

The procedure for forming the colored image on the tile in Example 5 was repeated except that the thermofusible toner B-1 employed in Example 5 was replaced by the thermofusible toner B-3 prepared in Production Example 3-3, whereby a black image was formed on the tile.

The thus obtained black image, however, was slightly dull.

EXAMPLE 8

The procedure for forming the colored image on the tile in Example 5 was repeated except that the thermofusible toner B-1 employed in Example 5 was replaced by the thermofusible toner B-4 prepared in Production Example 3-4, whereby a glossy black image was formed on the tile.

EXAMPLE 9

The procedure for forming the colored image on the tile in Example 5 was repeated except that the thermofusible toner B-1 employed in Example 5 was replaced by the thermofusible toner B-5 prepared in Production Example 3-5, whereby a glossy black image was formed on the tile.

EXAMPLE 10

[Image Formation by Use of Thermofusible Toner]

A mixture of 1000 g of carrier A prepared in Production Example 4 and 25 g of thermofusible toner B-4 prepared in Production Example 3-4 was stirred in a ball mill for 30 minutes, whereby a developer was obtained.

The thus prepared developer was incorporated in a commercially available dry type copying machine (Trademark "Imagio MF530" made by Ricoh Company, Ltd.), and a solid thermofusible toner image was formed so as to cover the entire surface of a commercially available transfer sheet for pottery (Trademark "OK Series SN-100" made by Nittoshiko Co., Ltd.).

[Toner Image Formation by Use of Color Toner]

A mixture of 1000 g of carrier A prepared in Production Example 4 and 25 g of color toner A-9 prepared in Production Example 2-9 was stirred in a ball mill for 30 minutes, whereby a developer was obtained.

The thus prepared developer was incorporated in another commercially available dry type copying machine (Trademark "Imagio MF530" made by Ricoh Company, Ltd.), and a colored toner image was further formed on the above-mentioned transfer sheet for pottery (Trademark "OK Series SN-100" made by Nittoshiko Co., Ltd.).

The thus formed solid thermofusible toner image and colored toner image bearing image transfer medium, was sprayed with a xylene solution of polystyrene, whereby a polystyrene film layer serving as a protective layer was formed on the toner image bearing side of the image transfer medium, so that a toner image layer was formed.

The thus prepared image transfer medium was immersed into water, and the toner image layer was peeled away from the image transfer medium. The thus peeled toner image layer was then applied to a commercially available white tile (Trademark "SP150" made by INAX Co., Ltd.).

The toner image layer applied tile was then sufficiently dried and burned at 900° C. for 1 hour in an electric furnace.

The burned tile was then gradually cooled. It was observed that a slightly dull black image was formed on the tile.

EXAMPLE 11

[Image Formation by Use of Thermofusible Toner]

A mixture of 1000 g of carrier A prepared in Production Example 4 and 25 g of thermofusible toner B-4 prepared in Production Example 3-4 was stirred in a ball mill for 30 minutes, whereby a developer was obtained.

The thus prepared developer was incorporated in a commercially available dry type copying machine (Trademark "Imagio XP530"made by Ricoh Company, Ltd.), and a solid thermofusible toner image was formed so as to cover the entire surface of a commercially available transfer sheet for pottery (Trademark "OK Series SN-100" made by Nittoshiko Co., Ltd.).

[Toner Image Formation by Use of Color Toner]

A mixture of 1000 g of carrier A prepared in Production Example 4 and 25 g of color toner A-9 prepared in Production Example 2-9 was stirred in a ball mill for 30 minutes, whereby a developer was obtained.

The thus prepared developer was incorporated in another commercially available dry type copying machine (Trademark "Imagio XF530" made by Ricoh Company, Ltd.), and a colored toner image was further formed on the above-mentioned transfer sheet for pottery (Trademark "OK Series SN-100" made by Nittoshiko Co., Ltd.).

[Image Formation by Use of Thermofusible Toner]

A mixture of 1000 g of carrier A prepared in Production Example 4 and 25 g of thermofusible toner B-4 prepared in Production Example 3-4 was stirred in a ball mill for 30 minutes, whereby a developer was obtained.

The thus prepared developer was incorporated in another commercially available dry type copying machine (Trademark "Imagio MF530" made by Ricoh Company, Ltd.), and a solid thermofusible toner image was formed go as to cover the entire surface of the above-mentioned transfer sheet for pottery (Trademark "OK Series SN-100" made by Nittoshiko Co., Ltd.).

The thus formed toner-images bearing image transfer medium, was sprayed with a xylene solution of polystyrene, whereby a polystyrene film layer serving as a protective layer was formed on the toner images bearing side of the image transfer medium, so that a toner image layer was formed.

The thus prepared image transfer medium was immersed into water, and the toner image layer was peeled away from the image transfer medium. The thus peeled toner image layer was then applied to a commercially available white tile (Trademark "RS-252" made by INAX Co., Ltd.).

The toner image layer applied tile was then sufficiently dried and burned at 900° C. for 1 hour in an electric furnace.

The burned tile was then gradually cooled. It was observed that a glossy black image was formed on the tile.

Since the uppermost toner layer was sufficiently transparent, no decrease in image density was observed with respect to the image formed on the tile.

EXAMPLE 12

A colored toner image was further formed so as to be overlaid on the image transfer medium as obtained in Example 11 by use of the same developer containing the color toner A-9 as employed in Example 11.

The thus formed toner-images bearing image transfer medium, was sprayed with a xylene solution of polystyrene, whereby a polystyrene film layer serving as a protective layer was formed on the toner images bearing side of the image transfer medium, so that a toner image layer was formed.

The thus prepared image transfer medium was immersed into water, and the toner image layer was peeled away from the image transfer medium. The thus peeled toner image layer was than applied to a commercially available white tile (Trademark "RS-252" made by INAX Co., Ltd.).

The toner image layer applied tile was then sufficiently dried and burned at 900° C. for 1 hour in an electric furnace.

The burned tile was then gradually cooled. It was observed that a glossy black image was formed on the tile.

A black image in the uppermost layer formed by the color toner A-9 was slightly dull, but the image portion formed by the thermofusible toner B-4 was sufficiently glossy.

EXAMPLE 13

A mixture of 1000 g of carrier A prepared in Production Example 4 and 25 g of thermofusible toner B-4 prepared in Production Example 3-4 was stirred in a ball mill for 30 minutes, whereby a developer was obtained.

The thus prepared developer was incorporated in a commercially available dry type copying machine (Trademark "Imagio MF530" made by Ricoh Company, Ltd.), and a five-layered solid thermofusible toner image was formed so as to cover the entire surface of a commercially available transfer sheet for pottery (Trademark "OK Series SN-100" made by Nittoshiko Co., Ltd.).

A mixture of 400 g of carrier A prepared in Production Example 4 and 20 g of a black color toner A-9 prepared in Production Example 2-9 was stirred in a ball mill for 30 minutes, whereby a black developer was obtained.

The thus prepared black developer was incorporated in a black color development section of a commercially available color copying machine (Trademark "PRETER 550" made by Ricoh Company, Ltd.).

A mixture of 400 g of carrier A prepared in Production Example 4 and 20 g of a yellow color toner A-10 prepared in Production Example 2-10 was stirred in a ball mill for 30 minutes, whereby a yellow developer was obtained.

The thus prepared yellow developer was incorporated in a yellow color development section of the above-mentioned color copying machine.

A mixture of 400 g of carrier A prepared in Production Example 4 and 20 g of a magenta color toner A-11 prepared in Production Example 2-11 was stirred in a ball mill for 30 minutes, whereby a magenta developer was obtained.

The thus prepared magenta developer was incorporated in a magenta color development section of the above-mentioned color copying machine.

A mixture of 400 g of carrier A prepared in Production Example 4 and 20 g of a cyan color toner A-12 prepared in Production Example 2-12 was stirred in a ball mill for 30 minutes, whereby a cyan developer was obtained.

The thus prepared cyan developer was incorporated in a cyan color development section of the above-mentioned color copying machine.

A full color toner image was formed on the previously mentioned five-layered solid thermofusible toner image bearing transfer sheet for pottery (Trademark "OK Series SN-100" made by Nittoshiko Co., Ltd.), by use of the above-mentioned color copying machine, using a full color photograph as an original therefor, placed on a contact glass of the color copying machine, whereby a full-color-toner image bearing image transfer sheet was prepared.

On the thus prepared full-color-toner image bearing image transfer sheet, another five-layered solid thermofusible toner image was formed so as to cover the entire surface of the full-color-toner image of the image transfer sheet by the above-mentioned copying machine, whereby a full-color-toner image bearing image transfer medium was prepared.

The thus formed toner-images bearing image transfer medium, was sprayed with a xylene solution of polystyrene, whereby a polystyrene film layer serving as a protective layer was formed on the toner images bearing side of the image transfer medium, so that a toner image layer was formed.

The thus prepared image transfer medium was immersed into water, and the toner image layer was peeled away from the image transfer medium. The thus peeled toner image layer was then applied to a commercially available white tile (Trademark "RS-252" made by INAX Co., Ltd.).

The toner image layer applied tile was then sufficiently dried and burned at 900° C. for 1 hour in an electric furnace.

The burned tile was then gradually cooled. It was observed that a glossy full color image with high image density was formed on the tile.

EXAMPLE 14

A light-brown colored unglazed pottery plate was prepared.

A coating liquid was prepared by mixing the following components:

| | Parts by Weight |
|---|---|
| Paint white for pottery (Trademark "191230" made by Degussa Japan Co., Ltd.) | 20 |
| Water-soluble medium (made by Isekyu Co., Ltd.) | 100 |

The thus prepared coating liquid was coated on the unglazed pottery plate by use of a doctor blade, and dried at 150° C. for 1 hour, whereby a white powder layer with a thickness of 300 μm was provided thereon.

The thus prepared white powder layer bearing pottery plate was burned at 800° C. for 1 hour, whereby a white ceramic layer with a thickness of about 240 μm was formed on the pottery plate.

The surface of the white ceramic layer had a high degree of whiteness, was smooth and had a reflectivity of 93 to 98% with respect to the light with a wavelength of 480 to 780 nm when measured by a spectrophotometer.

Another coating liquid was then prepared by mixing the following components:

| | Parts by Weight |
|---|---|
| Glass flux (Trademark "10034" made by Degussa Japan Co., Ltd.) | 20 |
| Water-soluble medium (made by Isekyu Co., Ltd.) | 100 |

The thus prepared coating liquid was coated on the white ceramic layer by use of a doctor blade, and dried at 150° C. for 1 hour, whereby a white powder layer with a thickness of 40 μm was formed thereon.

The thus prepared white powder layer bearing plate was burned at 800° C. for 1 hour, whereby a transparent ceramic layer was formed on the white ceramic layer.

No changes were observed in the whiteness of the white ceramic layer because of the provision of the transparent ceramic layer.

A mixture of 1000 g of carrier A prepared in Production Example 4 and 25 g of thermofusible toner B-4 prepared in Production Example 3-4 was stirred in a ball mill for 30 minutes, whereby a developer was obtained.

The thus prepared developer was incorporated in a commercially available dry type copying machine (Trademark "Imagio MP530" made by Ricoh Company, Ltd.), and a five-layered solid thermofusible toner image was formed so as to cover the entire surface of a commercially available transfer sheet for pottery (Trademark "OK Series SN-100" made by Nittoshiko Co., Ltd.).

A mixture of 400 g of carrier A prepared in Production Example 4 and 20 g of a black color toner A-9 prepared in Production Example 2-9 was stirred in a ball mill for 30 minutes, whereby a black developer was obtained.

The thus prepared black developer was incorporated in a black color development section of a commercially available color copying machine (Trademark "PRETER 550" made by Ricoh Company, Ltd.).

A mixture of 400 g of carrier A prepared in Production Example 4 and 20 g of a yellow color toner A-10 prepared in Production Example 2-10 was stirred in a ball mill for 30 minutes, whereby a yellow developer was obtained.

The thus prepared yellow developer was incorporated in a yellow color development section of the abovementioned color copying machine.

A mixture of 400 g of carrier A prepared in Production Example 4 and 20 g of a magenta color toner A-11 prepared in Production Example 2-11 was stirred in a ball mill for 30 minutes, whereby a magenta developer was obtained.

The thus prepared magenta developer was incorporated in a magenta color development section of the above-mentioned color copying machine.

A mixture of 400 g of carrier A prepared in Production Example 4 and 20 g of a cyan color toner A-12 prepared in Production Example 2-12 was stirred in a ball mill for 30 minutes, whereby a cyan developer was obtained.

The thus prepared cyan developer was incorporated in a cyan color development section of the above-mentioned color copying machine.

A full color toner image was formed on the previously mentioned five-layered solid thermofusible toner image bearing transfer sheet for pottery (Trademark "OK Series SN-100" made by Nittoshiko Co., Ltd.), by use of the above-mentioned color copying machine, using a full color photograph as an original therefor, placed on a contact glass of the color copying machine, whereby a full-color-toner image bearing image transfer sheet was prepared.

On the thus prepared full-color-toner image bearing image transfer sheet, another five-layered solid thermofusible toner image was formed so as to cover the entire surface of the full-color-toner image of the image transfer sheet by the above-mentioned copying machine, whereby a full-color-toner image bearing image transfer medium was prepared.

The thus formed toner-images bearing image transfer medium, was sprayed with a xylene solution of polystyrene, whereby a polystyrene film layer serving as a protective layer was formed on the toner images bearing side of the image transfer medium, so that a toner image layer was formed.

The thus prepared image transfer medium was immersed into water, and the toner image layer was peeled away from the image transfer medium. The thus peeled toner image layer was then applied to the surface of the transparent ceramic layer of the previously mentioned plate.

The toner image layer applied plate was then sufficiently dried and burned at 850° C. for 1 hour in an electric furnace.

The burned plate was then gradually cooled. It was observed that a glossy full color image with high image density was formed on the plate. Furthermore, the degree of whiteness of the white ceramic layer was so high that the clarity of the formed image was excellent.

Japanese Patent Application No. 7-182118 filed Jun. 26, 1995, and Japanese Patent Application filed Apr. 30, 1996, are hereby incorporated by reference.

What is claimed is:

1. A method of forming a toner image layer comprising at least one colored toner image layer on an image formation film, comprising the steps of:

developing a latent electrostatic image with at least one color toner which comprises an inorganic coloring material and a binder resin to a colored toner image;

transferring said colored toner image to a surface of an image formation film of an image transfer medium which comprises an image formation film comprising a heat-vanishing material and/or a thermofusible inorganic material one time or a plurality of times; and fixing said colored toner image to said image formation film at least one time to form a colored toner image layer thereon.

2. A method of forming a colored image on a heat resistant solid surface comprising the steps of:

developing a latent electrostatic image with at least one color toner which comprises an inorganic coloring material and a binder resin to a colored toner image;

transferring said colored toner image to a surface of an image formation film of an image transfer medium which comprises an image formation film comprising a heat-vanishing material and/or a thermofusible inorganic material one time or a plurality of times;

fixing said colored toner image to the surface of said image formation film at least one time, thereby forming a toner-image-layer-bearing image formation film, with said toner image layer comprising at least one colored toner image layer; and overlaying said toner-image-layer-bearing image formation film on said heat resistant solid surface; and burning said toner-image-layer bearing image formation film in a temperature range in which said thermofusible inorganic material is melted.

3. The method as claimed in claim 1, wherein said colored toner image layer comprises at least two colored layers selected from the group consisting of a yellow toner image layer, a magenta toner image layer, a cyan toner image layer and a black toner image layer.

4. The method as claimed in claim 2, wherein said colored toner image layer comprises at least two colored layers selected from the group consisting of a yellow toner image layer, a magenta toner image layer, a cyan toner image layer and a black toner image layer.

5. The method as claimed in claim 1, wherein said color toner further comprises a thermofusible inorganic material which is capable of forming a transparent vitreous solid when cooled after fused.

6. The method as claimed in claim 2, wherein said color toner further comprises a thermofusible inorganic material which is capable of forming a transparent vitreous solid when cooled after fused.

7. The method as claimed in claim 1, wherein said thermofusible inorganic material for said image formation film comprises glass powder.

8. The method as claimed in claim 2, wherein said thermofusible inorganic material for said image formation film comprises glass powder.

9. The method as claimed in claim 1, wherein said image transfer medium consists essentially of said image formation film, with one side thereof constituting an image formation surface.

10. The method as claimed in claim 2, wherein said image transfer medium consists essentially of said image formation film, with one side thereof constituting an image formation surface thereof.

11. The method as claimed in claim 1, wherein said image transfer medium comprises a base paper, a tacky or adhesive agent layer formed thereon, and said image formation film which is formed on said tacky or adhesive agent layer.

12. The method as claimed in claim 2, wherein said image transfer medium comprises a tacky or adhesive agent layer formed thereon and said image formation film which is formed on said tacky or adhesive agent layer.

13. The method as claimed in claim 1, wherein said image transfer medium comprises a base paper, a dry tacky or dry adhesive agent layer formed thereon, and said image formation film which is formed on said dry tacky or dry adhesive agent layer.

14. The method as claimed in claim 2, wherein said image transfer medium comprises a dry tacky or dry adhesive agent layer formed thereon, and said image formation film which is formed on said dry tacky or dry adhesive agent layer.

15. The method as claimed in claim 2, wherein said heat resistant solid surface is vitreous.

16. A method of forming a toner image layer comprising at least one colored toner image layer and at least one thermofusible toner image layer on an identical image formation film, by use of process A and process B in combination, said process A comprising the steps of:

developing a latent electrostatic image with at least one color toner which comprises an inorganic coloring material and a binder resin to a colored toner image;

transferring said colored toner image to a surface of an image formation film of an image transfer medium which comprises an image formation film comprising a heat-vanishing material and/or a thermofusible inorganic material; and fixing said colored toner image to the surface of said image formation film to form a colored toner image layer thereon; and said process B comprising the steps of:

developing a latent electrostatic image with at least one thermofusible toner which comprises a thermofusible inorganic material which is capable of forming a transparent vitreous solid when cooled after fused, and a binder resin to a thermofusible toner image;

transferring said thermofusible toner image to the surface of said image formation film of said image transfer medium; and fixing said thermofusible toner image to the surface of said image formation film to form a thermofusible toner image layer thereon.

17. A method of forming a colored image on a heat resistant solid surface comprising the steps of:

(I) preparing a toner-image-layer bearing image formation film by forming a toner image layer comprising at least one colored toner image layer and at least one thermofusible toner image layer on an identical image formation film, by use of process A and process B in combination, said process A comprising the steps of:

developing a latent electrostatic image with at least one color toner which comprises an inorganic coloring material and a binder resin to a colored toner image;

transferring said colored toner image to a surface of an image formation film of an image transfer medium which comprises an image formation film comprising a heat-vanishing material and/or a thermofusible inorganic material; and fixing said colored toner image to the surface of said image formation film to form a colored toner image layer thereon; and said process B comprising the steps of:

developing a latent electrostatic image with at least one thermofusible toner which comprises a thermofusible inorganic material which is capable of forming a transparent vitreous solid when cooled after fused, and a binder resin to a thermofusible toner image;

transferring said thermofusible toner image to the surface of said image formation film of said image transfer medium; and fixing said thermofusible toner image to the surface of said image formation film to form a thermofusible toner image layer thereon, thereby preparing a toner-image-layer bearing image formation film; and (II) overlaying said toner-image-layer-bearing image formation film on said heat resistant solid surface; and burning said toner-image-layer bearing image formation film in a temperature range in which said thermofusible inorganic material is melted.

18. The method as claimed in claim 16, wherein said toner image layer formed on said image formation film has an outermost layer and an innermost layer, at least one of which comprises said thermofusible toner image layer.

19. The method as claimed in claim 17, wherein said toner image layer formed on said image formation film comprises has an outermost layer and an innermost layer, at least one of which comprises said thermofusible toner image layer.

20. The method as claimed in claim 16, wherein said thermofusible toner image layer is interposed between a plurality of said colored toner image layers.

21. The method as claimed in claim 17, wherein said thermofusible toner image layer is interposed between a plurality of said colored toner image layers.

22. The method as claimed in claim 16, wherein said colored toner image layer comprises at least two layers selected from the group consisting of a yellow toner image layer, a magenta toner image layer, a cyan toner image layer and a black toner image layer.

23. The method as claimed in claim 17, wherein said colored toner image layer comprises at least two layers selected from the group consisting of a yellow toner image layer, a magenta toner image layer, a cyan toner image layer and a black toner image layer.

24. The method as claimed in claim 16, wherein said thermofusible toner layer forms a solid image area.

25. The method as claimed in claim 17, wherein said thermofusible toner layer forms a solid image area.

26. The method as claimed in claim 16, wherein said color toner further comprises a thermofusible inorganic material which is capable of forming a transparent vitreous solid when cooled after fused.

27. The method as claimed in claim 17, wherein said color toner further comprises a thermofusible inorganic material which is capable of forming a transparent vitreous solid when cooled after fused.

28. The method as claimed in claim 16, wherein said color toner further comprises a thermofusible toner which comprises a thermofusible inorganic material which is capable of forming a transparent vitreous solid when cooled after fused, and a binder resin.

29. The method as claimed in claim 17, wherein said color toner further comprises a thermofusible toner which comprises a thermofusible inorganic material which is capable of forming a transparent vitreous solid when cooled after fused, and a binder resin.

30. The method as claimed in claim 16, wherein said thermofusible inorganic material for said image formation film comprises glass powder.

31. The method as claimed in claim 17, wherein said thermofusible inorganic material for said image formation film comprises glass powder.

32. The method as claimed in claim 16, wherein said image transfer medium consists essentially of said image formation film, with one side thereof constituting an image formation surface.

33. The method as claimed in claim 17, wherein said image transfer medium consists essentially of said image formation film, with one side thereof constituting an image formation surface thereof.

34. The method as claimed in claim 16, wherein said image transfer medium comprises a base paper, a tacky or adhesive agent layer formed thereon, and said image formation film which is formed on said tacky or adhesive agent layer.

35. The method as claimed in claim 17, wherein said image transfer medium comprises a tacky or adhesive agent layer formed thereon and said image formation film which is formed on said tacky or adhesive agent layer.

36. The method as claimed in claim 16, wherein said image transfer medium comprises a base paper, a dry tacky or dry adhesive agent layer formed thereon, and said image formation film which is formed on said dry tacky or dry adhesive agent layer.

37. The method as claimed in claim 17, wherein said image transfer medium comprises a dry tacky or dry adhesive agent layer formed thereon, and said image formation film which is formed on said dry tacky or dry adhesive agent layer.

38. The method as claimed in claim 17, wherein said heat resistant solid surface is vitreous.

39. A method of forming a toner image layer comprising at least one colored toner image layer on an image formation film, with a thermofusible inorganic material layer or a thermofusible toner layer being provided on said color toner image layer, comprising the steps of:

developing a latent electrostatic image with at least one color toner which comprises an inorganic coloring material and a binder resin to a colored toner image;

transferring said colored toner image to a surface of an image formation film of an image transfer medium which comprises an image formation film comprising a heat-vanishing material and/or a thermofusible inorganic material one time or a plurality of times;

fixing said colored toner image to said image formation film at least one time to form a colored toner image layer on said image formation film; and forming a thermofusible inorganic material layer comprising a thermofusible inorganic material capable of forming a transparent vitreous solid when cooled after fused, or a thermofusible toner layer comprising said thermofusible inorganic material and a binder resin, on said color toner image layer.

40. A method of forming a colored image on a heat resistant solid surface comprising the steps of:

(I) preparing a toner-image-bearing image formation film by forming a toner image layer comprising at least one colored toner image layer on an image formation film, with a thermofusible inorganic material layer or a thermofusible toner layer being provided on said color toner image layer, comprising the steps of:

developing a latent electrostatic image with at least one color toner which comprises an inorganic coloring material and a binder resin to a colored toner image;

transferring said colored toner image to a surface of an image formation film of an image transfer medium which comprises an image-formation film comprising a heat-vanishing material and/or a thermofusible inorganic material one time or a plurality of times;

fixing said colored toner image to said image formation film at least one time to form a colored toner image layer on said image formation film; and forming a thermofusible inorganic material layer comprising a thermofusible inorganic material capable of forming a transparent vitreous solid when cooled after fused, or a thermofusible toner layer comprising said thermofusible inorganic material and a binder resin, on said color toner image layer, thereby preparing a toner-image-bearing image formation film; and (II) overlaying said toner-image-layer-bearing image formation film on said heat resistant solid surface; and burning said toner-image-layer bearing image formation film in a temperature range in which said thermofusible inorganic material is melted.

41. The method as claimed in claim 39, wherein at least one of said thermofusible inorganic material for said image formation film or said thermofusible inorganic material for said thermofusible inorganic material layer comprises glass powder.

42. The method as claimed in claim 40, wherein at least one of said thermofusible inorganic material for said image formation film or said thermofusible inorganic material for said thermofusible inorganic material layer comprises glass powder.

43. The method as claimed in claim 39, wherein said colored toner image layer comprises at least two colored layers selected from the group consisting of a yellow toner image layer, a magenta toner image layer, a cyan toner image layer and a black toner image layer.

44. The method as claimed in claim 40, wherein said colored toner image layer comprises at least two colored layers selected from the group consisting of a yellow toner image layer, a magenta toner image layer, a cyan toner image layer and a black toner image layer.

45. The method as claimed in claim 40, wherein said heat resistant solid surface is vitreous.

46. An inorganic toner for developing latent electrostatic image comprising an inorganic coloring material, a thermofusible inorganic material which is capable of forming a transparent vitreous solid when cooled after fused, a charge controlling agent, and a binder resin.

47. A thermofusible toner for developing latent electrostatic image comprising a thermofusible inorganic material which is capable of forming a transparent vitreous solid when cooled after fused, and a binder resin.

48. An inorganic toner for developing latent electrostatic image comprising:

(a) a color toner comprising an inorganic coloring material and a binder resin; and (b) a thermofusible toner comprising a thermofusible inorganic material which is capable of forming a transparent vitreous solid when cooled after fused, and a binder resin.

49. The inorganic toner as claimed in claim 46, wherein said thermofusible inorganic material comprises glass powder.

50. The inorganic toner as claimed in claim 47, wherein said thermofusible inorganic material comprises glass powder.

51. The inorganic toner as claimed in claim 48, wherein said thermofusible inorganic material comprises glass powder.

52. An image transfer medium comprising an image formation film which comprises a heat-vanishing material and/or a thermofusible inorganic material, constituting an image formation surface, with a toner image layer comprising at least one colored toner image and at least one thermofusible toner layer being formed on said image formation film.

53. An image transfer medium comprising an image formation film which comprises a heat-vanishing material and/or a thermofusible inorganic material, constituting an image formation surface, with a toner image layer comprising at least one colored toner image being formed on said image formation film, and with a thermofusible inorganic material layer comprising a thermofusible inorganic material capable of forming a transparent vitreous solid when cooled after fused, or a thermofusible toner layer comprising said thermofusible inorganic material and a binder resin, being overlaid on said color toner image layer.

* * * * *

UNITED STATES PATENT AND TRADEMARK OFFICE

CERTIFICATE OF CORRECTION

PATENT NO. : 5,750,299

DATED : May 12, 1998

INVENTOR(S) : Kouchi Ohshima, et al.

It is certified that error appears in the above-identified patent and that said Letters Patent is hereby corrected as shown below:

Column 2, Line 17, "invention is to" should read --invention to--.

Column 6, Line 13, "3(a)" should read --3(c)--.

Column 16, Line 38, "rain" should read --resin--.

Column 18, Line 52, "steps of;" should read --steps of:--.

Column 21, Line 20, "toner-image layer" should read --toner-image-layer--.

Column 22, Line 42, "(Mn, Co)O.(" should read --(Mn, Co)O·(--.

Column 23, Line 4, "(Mn, Co)O.(" should read --(Mn, Co)O·(--.

Column 23, Line 5, "inorgainc" should read --inorganic--.

Column 23, Line 32, "inorgainc" should read --inorganic--.

Column 23, Line 57, "(Zn, Co)O.$Al_2O_3$" should read --(Zn, Co)O·$Al_2O_3$--.

Column 24, Line 19, "(Mn, Co)O.(Cr, Fe)$_2O_3$" should read --(Mn, Co)O·(Cr, Fe)$_2O_3$--.

Column 24, Line 20, "inorgainc" should read --inorganic--.

UNITED STATES PATENT AND TRADEMARK OFFICE

CERTIFICATE OF CORRECTION

PATENT NO. : 5,750,299

DATED : May 12, 1998

INVENTOR(S) : Kouchi Ohshima, et al.

It is certified that error appears in the above-identified patent and that said Letters Patent is hereby corrected as shown below:

Column 24, Line 43, "paths;" should read --paths:--.

Column 25, Line 14, "$ZnO.(Al, Cr)_2O_3$" should read --$ZnO \cdot (Al, Cr)_2O_3$--.

Column 25, Line 15, "inorgainc" should read --inorganic--.

Column 26, Line 7, "$(Mn, Co)O.(Cr, Fe)_2O_3$" should read --$(Mn, Co)O \cdot (Cr, Fe)_2O_3$--.

Column 27, Line 11, "paths;" should read --paths:--.

Column 28, Line 23, "prcpared;" should read --prepared:--.

Column 28, Line 35, delete "the".

Column 30, Line 28, "abovementioned" should read --above-mentioned--.

Column 30, Line 41, "multicolor-toner" should read --multi-color-tone--.

Column 30, Line 66, ""OR" should read --"OK--.

Column 33, Line 17, "go" should read --so--.

UNITED STATES PATENT AND TRADEMARK OFFICE

CERTIFICATE OF CORRECTION

PATENT NO. : 5,750,299

DATED : May 12, 1998

INVENTOR(S) : Kouchi Ohshima, et al.

It is certified that error appears in the above-identified patent and that said Letters Patent is hereby corrected as shown below:

Column 39, Line 22, delete "comprises".

Column 42, Line 4, "fused, and" should read --fused, a charge controlling agent, and--.

Column 42, Line 13, "fused, and" should read --fused, a charge controlling agent, and--.

Signed and Sealed this

Twenty-first Day of December, 1999

*Attest:*

Q. TODD DICKINSON

*Attesting Officer*

*Acting Commissioner of Patents and Trademarks*